US011132939B2

(12) United States Patent
Yen et al.

(10) Patent No.: US 11,132,939 B2
(45) Date of Patent: Sep. 28, 2021

(54) DISPLAY SYSTEM AND SHARED DRIVING CIRCUIT THEREOF

(71) Applicant: MACROBLOCK, INC., Hsinchu (TW)

(72) Inventors: Hung-Lin Yen, Hsinchu (TW); Shun-Ching Hsieh, Hsinchu (TW)

(73) Assignee: MACROBLOCK, INC., Hsinchu (TW)

( * ) Notice: Subject to any disclaimer, the term of this patent is extended or adjusted under 35 U.S.C. 154(b) by 0 days.

(21) Appl. No.: 16/822,584

(22) Filed: Mar. 18, 2020

(65) Prior Publication Data

US 2020/0312232 A1 Oct. 1, 2020

(30) Foreign Application Priority Data

Mar. 28, 2019 (TW) ..... 108111062

(51) Int. Cl.
*G09G 3/32* (2016.01)

(52) U.S. Cl.
CPC ..... *G09G 3/32* (2013.01); *G09G 2310/0264* (2013.01)

(58) Field of Classification Search
CPC ..... G09G 3/32; G09G 2310/0264; G09G 2310/0221; G09G 2310/0278; G09G 3/3208; G09G 3/3233; G09G 3/3266; G09G 2330/021
See application file for complete search history.

(56) References Cited

U.S. PATENT DOCUMENTS 6,437,766 B1 8/2002 Matsushima et al.
6,826,247 B1 * 11/2004 Elliott ..... G09G 5/008 375/376
8,325,119 B2 12/2012 Yi
8,575,860 B2 11/2013 Kikuchi
9,066,384 B2 6/2015 Kikuchi
9,355,589 B2 5/2016 Lu et al.
10,546,541 B2 1/2020 Tamura et al.
2008/0204391 A1 * 8/2008 Yi ..... G09G 3/2003 345/88

(Continued)

FOREIGN PATENT DOCUMENTS

CN 103857106 A 6/2014
CN 104867454 8/2015

(Continued)

OTHER PUBLICATIONS

Taiwan Intellectual Property Office, "Search Report" and English translation thereof, issued in Taiwan Patent Application No. 108111062, dated Nov. 8, 2019, document of 2 pages.

(Continued)

*Primary Examiner* — Ibrahim A Khan
(74) *Attorney, Agent, or Firm* — Akerman LLP; Peter A. Chiabotti

(57) ABSTRACT

A display system includes a number (M) of scan line units, a number (N) of channel line units, a number (R) of light emitting arrays connected to the scan line units and the channel line units, and a number (L) of shared driving circuits, where M≥1, N≥1, R≥1, and L is equal to a maximum of M and N when M≠N, and is equal to M otherwise. Each shared driving circuit is operable to generate or not to generate a scan driving output, and is operable to generate or not to generate a channel driving output. Each of a number (M) of the shared driving circuits is for providing the scan driving output to a respective scan line unit. Each of a number (N) of the shared driving circuits is for providing the scan driving output to a respective scan line unit.

19 Claims, 17 Drawing Sheets

(56) References Cited

U.S. PATENT DOCUMENTS

| | | | | |
|---|---|---|---|---|
| 2009/0096711 | A1* | 4/2009 | Jang | G06F 3/1446 345/1.3 |
| 2012/0001946 | A1* | 1/2012 | Cho | G09G 3/3426 345/690 |
| 2012/0268445 | A1* | 10/2012 | Ogata | H01L 27/3293 345/212 |
| 2012/0327129 | A1* | 12/2012 | Li | G09G 3/3426 345/690 |
| 2013/0300722 | A1* | 11/2013 | Gyouten | G09G 3/3685 345/204 |
| 2015/0194110 | A1* | 7/2015 | Park | G09G 3/3614 345/213 |
| 2015/0356928 | A1* | 12/2015 | Xie | G09G 3/3648 345/694 |
| 2016/0379561 | A1 | 12/2016 | Jin et al. | |
| 2019/0114980 | A1* | 4/2019 | Kim | G09G 3/3674 |

FOREIGN PATENT DOCUMENTS

| | | | |
|---|---|---|---|
| CN | 107103884 | | 8/2017 |
| EP | 1137188 | A2 | 9/2001 |
| JP | S59116791 | A | 7/1984 |
| JP | H07-030149 | A | 1/1995 |
| JP | H11338429 | A | 12/1999 |
| JP | H11344691 | A | 12/1999 |
| JP | 2005010567 | A | 1/2005 |
| JP | 2007065097 | A | 3/2007 |
| JP | 2011221262 | A | 11/2011 |
| JP | 2013019999 | A | 1/2013 |
| JP | 2016009112 | A | 1/2016 |
| JP | 2016505880 | A | 2/2016 |
| KR | 20150099731 | A | 9/2015 |
| TW | I334590 | | 12/2010 |
| TW | I622974 | B | 5/2018 |

OTHER PUBLICATIONS

Search Report issued to European counterpart application No. 20162389.9 by the EPO dated Nov. 3, 2020.

Office Action issued to Korean counterpart application No. 1020200037787 by the KIPO dated Apr. 26, 2021, with translation.

Japanese Patent Office, "Notice of Reasons Of Refusal," and English translation thereof, issued to Japanese counterpart application No. 2020-054635, dated Jul. 6, 2021, document of 7 pages.

* cited by examiner

DISPLAY SYSTEM AND SHARED DRIVING CIRCUIT THEREOF

CROSS-REFERENCE TO RELATED APPLICATION

This application claims priority of Taiwanese Patent Application No. 108111062, filed on Mar. 28, 2019.

FIELD

The disclosure relates to display techniques, and more particularly to a display system and a shared driving circuit thereof.

BACKGROUND

Referring to FIG. 1, a conventional display system includes a plurality of LED arrays 12, and a plurality of driving circuits 11 that respectively drive the LED arrays 12. Each of the LED arrays 12 includes a plurality of LED units (not shown) which are arranged in a matrix with a plurality of columns and a plurality of rows, and each of which corresponds to a pixel. In an example where the conventional display system has a resolution of 64×64 pixels, and where each LED array 12 includes 16×32 LED units that are arranged in a matrix with sixteen columns and thirty-two rows, eight LED arrays 12 and eight driving circuits 11 are required by the conventional display system.

As the resolution of the conventional display system increases (for example, to the FHD resolution of 1920×1080 pixels, or even to the 4K UHD resolution of 3840×2160 pixels), the number of the driving circuits 11 increases significantly, resulting in significant increase of power consumption of the conventional display system. However, as the number of the driving circuits 11 increases, it becomes difficult to fabricate the driving circuits 11 on a single chip. In addition, a printed circuit board with many layers is required to carry a large amount of traces of the conventional display system, resulting in significant increase of total cost of the conventional display system.

SUMMARY

Therefore, an object of the disclosure is to provide a display system and a shared driving circuit thereof. The display system can alleviate at least one drawback of the prior art.

According to an aspect of the disclosure, the display system includes a number (M) of scan line units, a number (N) of channel line units, a number (R) of light emitting arrays and a number (L) of shared driving circuits, where $M \geq 1$, where $N \geq 1$, where $R \geq 1$, and where L is equal to a maximum of M and N when $M \neq N$, and is equal to M otherwise. Each of the light emitting arrays is connected to a corresponding one of the scan line units and a corresponding one of the channel line units. Each of the shared driving circuits includes a control circuit, a scan driver and a channel driver. The control circuit is for receiving an enable control output, and generates a scan enable signal and a channel enable signal based on the enable control output. The scan driver is connected to the control circuit for receiving the scan enable signal therefrom, and is operable to generate or not to generate a scan driving output based on the scan enable signal. The channel driver is connected to the control circuit for receiving the channel enable signal therefrom, and is operable to generate or not to generate a channel driving output based on the channel enable signal. The scan driver of each of a number (M) of the shared driving circuits is further connected to a respective one of the scan line units for providing the scan driving output thereto. The channel driver of each of a number (N) of the shared driving circuits is further connected to a respective one of the channel line units for providing the channel driving output thereto.

According to another aspect of the disclosure, the shared driving circuit is to be used in a display system. The display system includes at least one scan line unit, at least one channel line unit, and at least one light emitting array that is connected to the at least one scan line unit and the at least one channel line unit. The shared driving circuit includes a control circuit, a scan driver and a channel driver. The control circuit is for receiving an enable control output, and generates a scan enable signal and a channel enable signal based on the enable control output. The scan driver is connected to the control circuit for receiving the scan enable signal therefrom, and is operable to generate or not to generate a scan driving output based on the scan enable signal. The channel driver is connected to the control circuit for receiving the channel enable signal therefrom, and is operable to generate or not to generate a channel driving output based on the channel enable signal. The scan driver is further connected to one of the at least one scan line unit for providing the scan driving output thereto. The channel driver is further connected to one of the at least one channel line unit for providing the channel driving output thereto.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
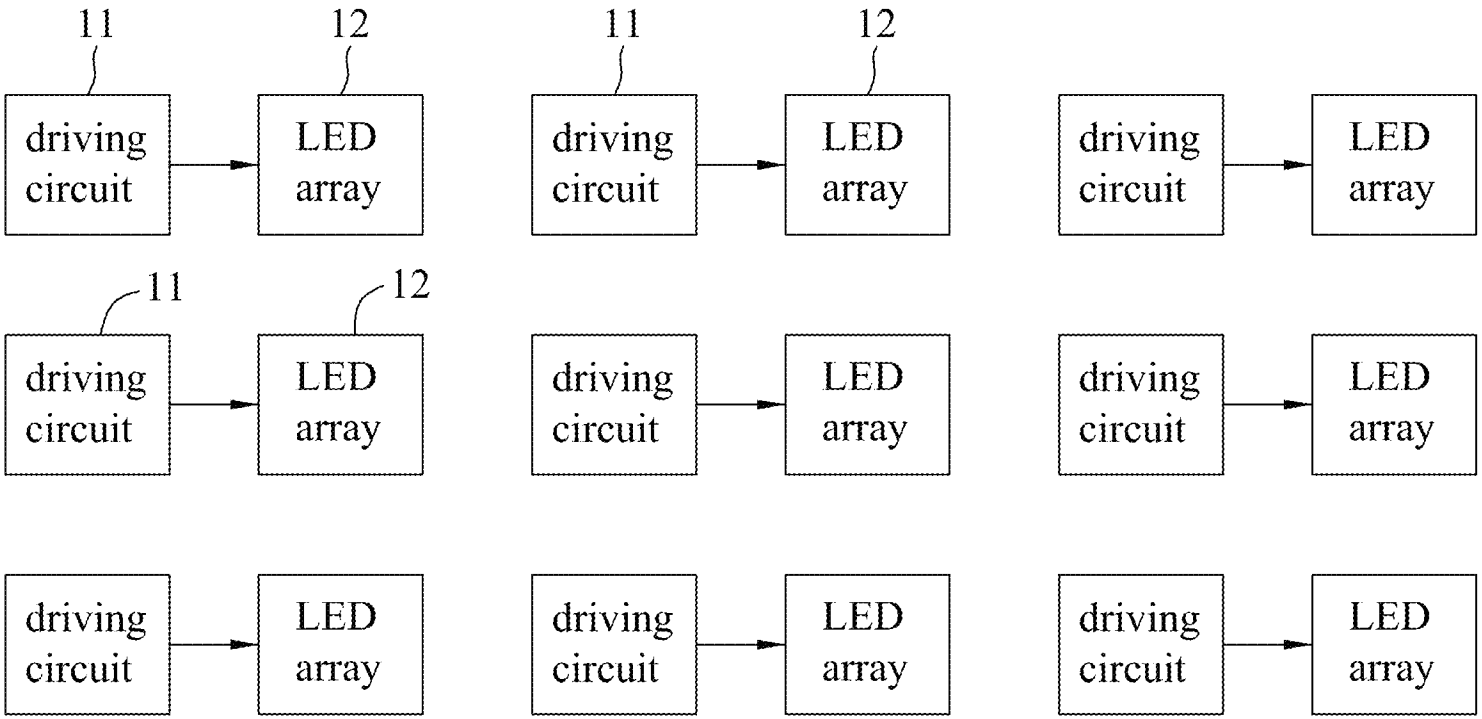
FIG.1 PRIOR ART
FIG. 1 is a block diagram illustrating a conventional display system.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
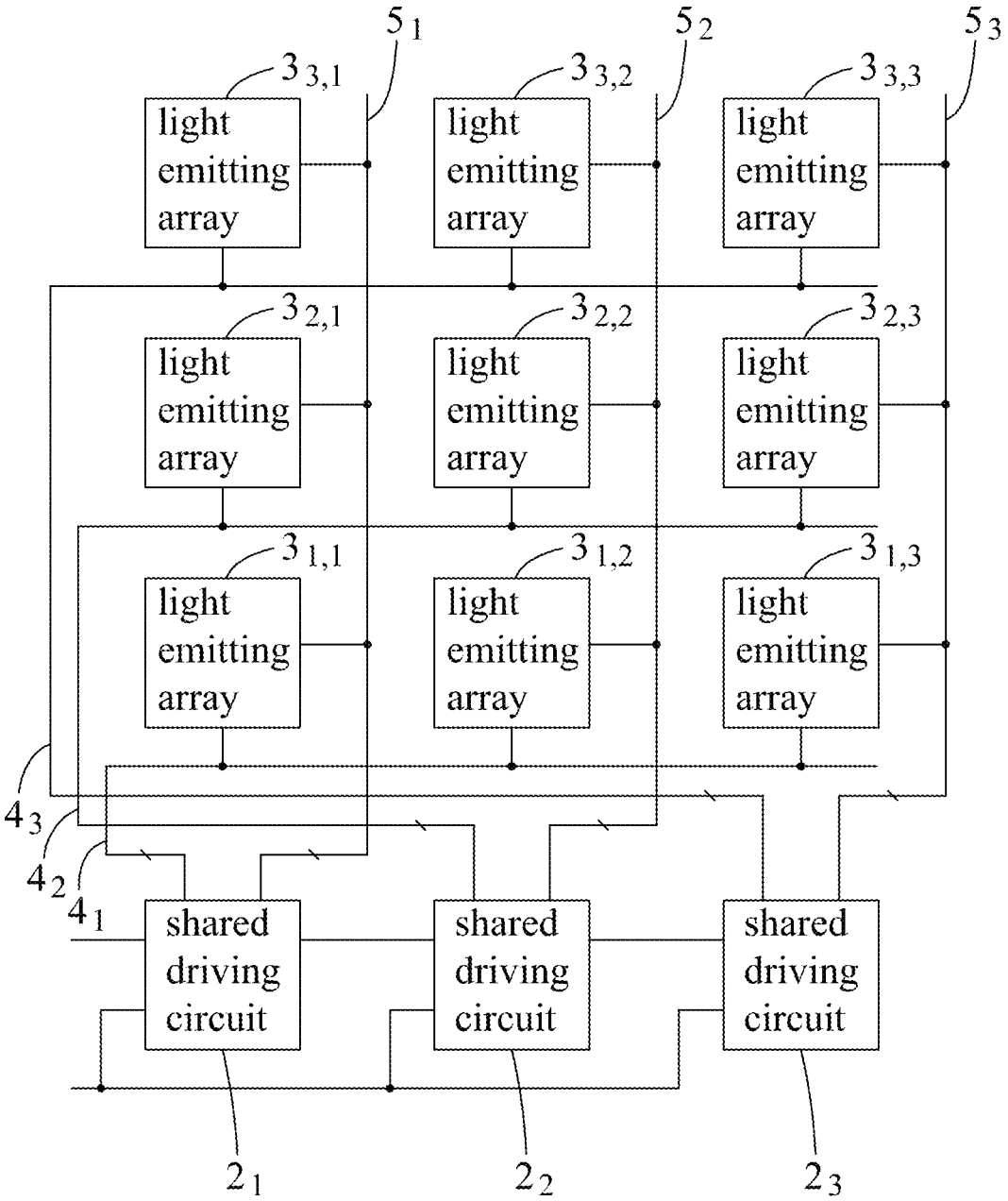
FIG. 2 is a block diagram illustrating a first embodiment of a display system according to the disclosure.

Referring to FIG. 2, a first embodiment of a display system according to the disclosure includes a number (M) of scan line units, a number (N) of channel line units, a number (R) of light emitting arrays and a number (L) of shared driving circuits, where M≥1, where N≥1, where R≥1, and where L is equal to a maximum of M and N when M≠N, and is equal to M otherwise. Each of the light emitting arrays is connected to a corresponding one of the scan line units and a corresponding one of the channel line units. Each of the shared driving circuits is operable to generate or not to generate a scan driving output based on a scan enable signal, and is operable to generate or not to generate a channel driving output based on a channel enable signal. Each of a number (M) of the shared driving circuits is connected to a respective one of the scan line units for providing the scan driving output thereto. Each of a number (N) of the shared driving circuits is connected to a respective one of the channel line units for providing the channel driving output thereto.

Figure 3:
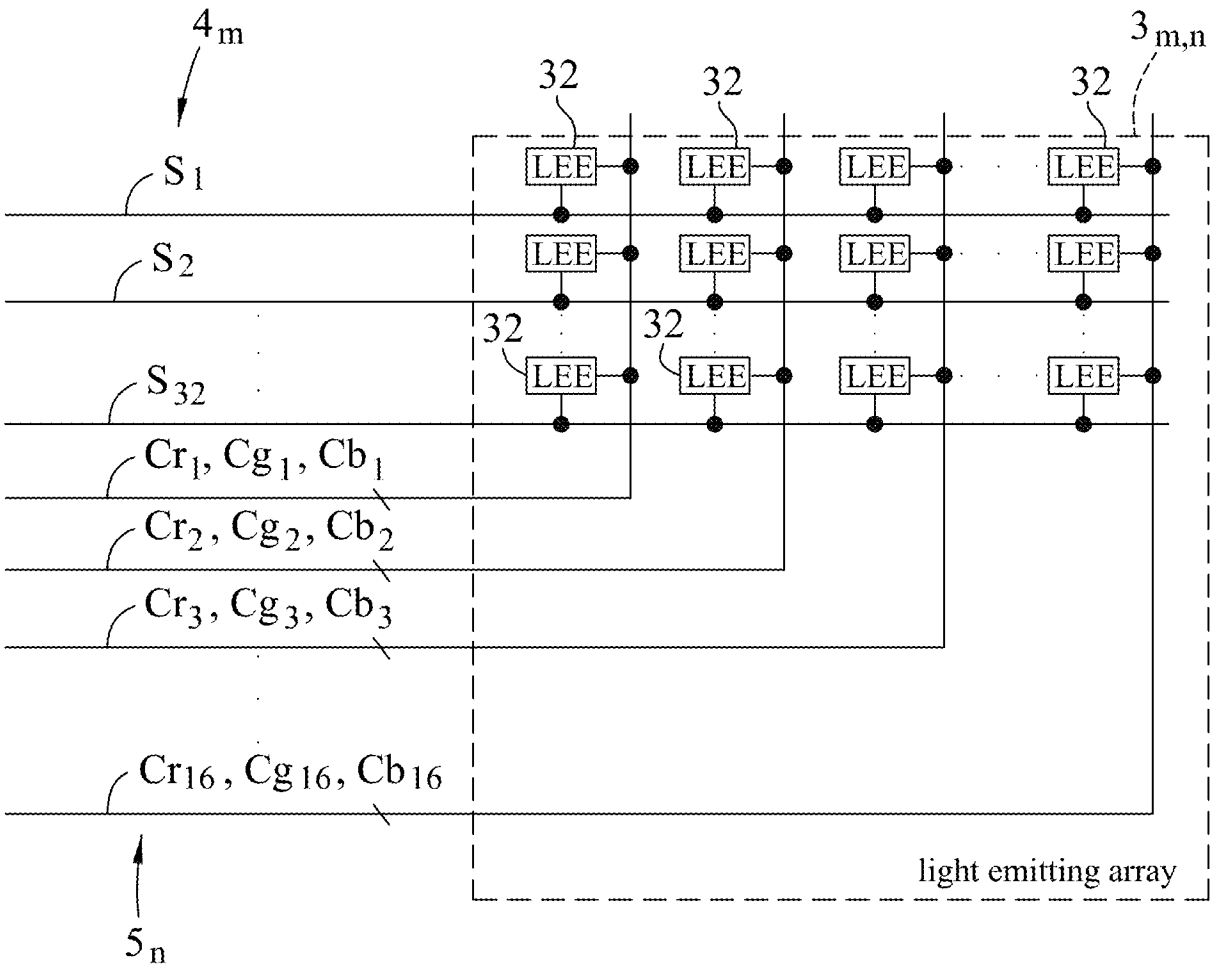
FIG. 3 is a block diagram illustrating a light emitting array of the first embodiment.

Referring to FIGS. 2 and 3, each of the scan line units includes a plurality of scan lines. Each of the channel line units includes a plurality of channel lines. Each of the light emitting arrays includes a plurality of light emitting elements (LEEs) 32 that are arranged in a matrix with a plurality of columns and a plurality of rows. In each of the light emitting arrays, for each of the rows of the light emitting elements 32, the light emitting elements 32 are connected to a respective one of the scan lines of the scan line unit corresponding to the light emitting array; and for each of the columns of the light emitting elements 32, the light emitting elements 32 are connected to at least one of the channel lines of the channel line unit corresponding to the light emitting array.

Figure 4:
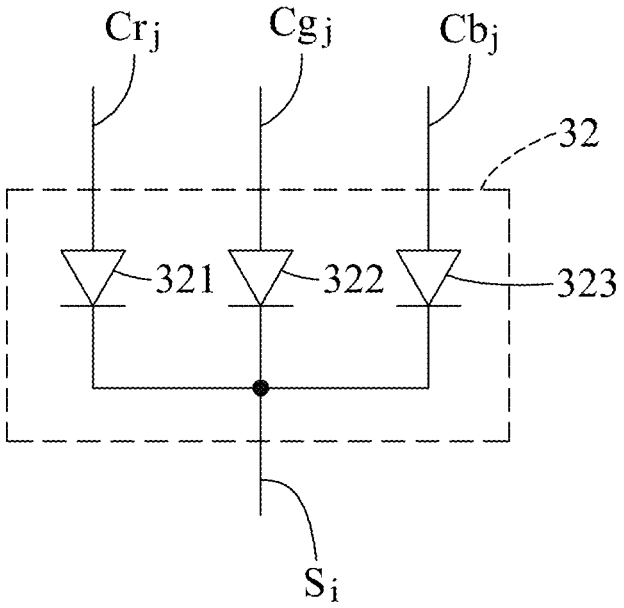
FIG. 4 is a circuit diagram illustrating a light emitting element of the light emitting array of the first embodiment.

Referring to FIGS. 2 to 4, for illustration purposes, in this embodiment, there are three scan line units $\mathbf{4}_1$-$\mathbf{4}_3$, three channel line units $\mathbf{5}_1$-$\mathbf{5}_3$ and nine light emitting arrays $\mathbf{3}_{1,1}$-$\mathbf{3}_{3,3}$. In other words, M=3, N=3 and R=9. The light emitting arrays $\mathbf{3}_{1,1}$-$\mathbf{3}_{3,3}$ are arranged in a matrix with three columns and three rows. For each of the rows of the light emitting arrays $\mathbf{3}_{1,1}$-$\mathbf{3}_{3,3}$, the light emitting arrays are connected to a respective one of the scan line units $\mathbf{4}_1$-$\mathbf{4}_3$. For each of the columns of the light emitting arrays $\mathbf{3}_{1,1}$-$\mathbf{3}_{3,3}$, the light emitting arrays are connected to a respective one of the channel line units $\mathbf{5}_1$-$\mathbf{5}_3$. Each of the scan line units $\mathbf{4}_1$-$\mathbf{4}_3$ includes thirty-two scan lines ($S_1$-$S_{32}$). Each of the channel line units $\mathbf{5}_1$-$\mathbf{5}_3$ includes forty-eight channel lines ($Cr_1$-$Cr_{16}$, $Cg_1$-$Cg_{16}$, $Cb_1$-$Cb_{16}$) that are divided into sixteen first channel lines ($Cr_1$-$Cr_{16}$), sixteen second channel lines ($Cg_1$-$Cg_{16}$) and sixteen third channel lines ($Cb_1$-$Cb_{16}$). Each of the light emitting arrays $\mathbf{3}_{1,1}$-$\mathbf{3}_{3,3}$ includes sixteen-by-thirty-two light emitting elements 32. In each of the light emitting arrays $\mathbf{3}_{1,1}$-$\mathbf{3}_{3,3}$, the light emitting elements 32 are arranged in a matrix with sixteen columns and thirty-two rows, and each includes a red light emitting diode (LED) 321, a green LED 322 and a blue LED 323; for each of the columns of the light emitting elements 32, anodes of the red LEDs 321 of the light emitting elements 32 are connected to a respective one of the first channel lines ($Cr_1$-$Cr_{16}$) of the channel line unit corresponding to the light emitting array, anodes of the green LEDs 322 of the light emitting elements 32 are connected to a respective one of the second channel lines ($Cg_1$-$Cg_{16}$) of the channel line unit corresponding to the light emitting array, and anodes of the blue LEDs 323 of the light emitting elements 32 are connected to a respective one of the third channel lines ($Cb_1$-$Cb_{16}$) of the channel line unit corresponding to the light emitting array; and for each of the rows of the light emitting elements 32, cathodes of the LEDs 321-323 of the light emitting elements 32 are connected to a respective one of the scan lines ($S_1$-$S_{32}$) of the scan line unit corresponding to the light emitting array. In other words, each of the light emitting arrays $\mathbf{3}_{1,1}$-$\mathbf{3}_{3,3}$ has a common cathode configuration in this embodiment.

Figure 5:
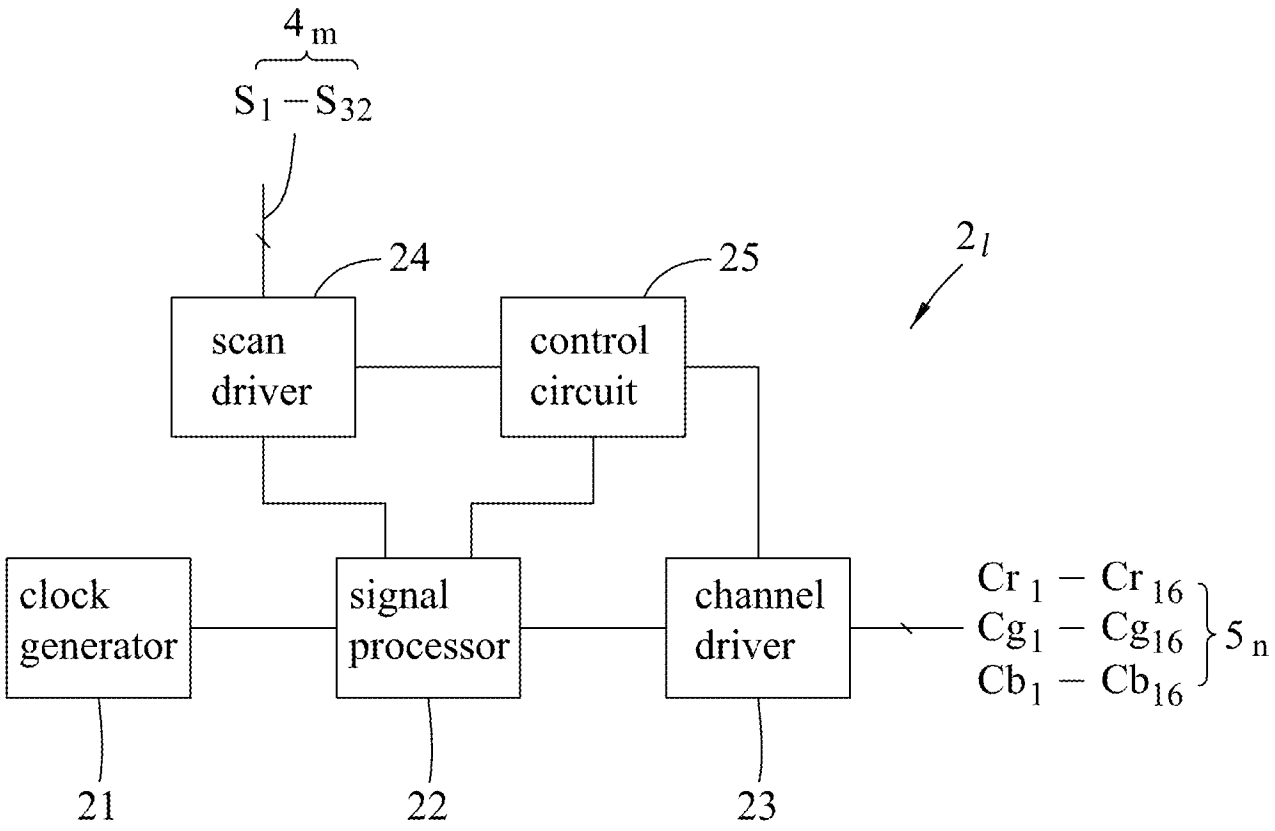
FIG. 5 is a block diagram illustrating a shared driving circuit of the first embodiment.

Referring to FIGS. 2 and 5, in this embodiment, there are three shared driving circuit $\mathbf{2}_1$-$\mathbf{2}_3$. In other words, L=3. Each of the shared driving circuits $\mathbf{2}_1$-$\mathbf{2}_3$ includes a clock generator 21, a signal processor 22, a channel driver 23, a scan driver 24 and a control circuit 25. The clock generator 21 generates an internal global clock signal based on a reference clock signal. The signal processor 22 is connected to the clock generator 21, provides an enable control output, and generates a scan control output and a channel control output based on at least the internal global clock signal from the clock generator 21 and display data. The control circuit 25 is connected to the signal processor 22, and generates the scan enable signal and the channel enable signal based on the enable control output from the signal processor 22. The channel driver 23 is connected to the signal processor 22 and the control circuit 25, and is operable to generate or not to generate the channel driving output based on the channel enable signal from the control circuit 25. The channel driving output is generated based on the channel control output from the signal processor 22, and includes forty-eight driving current signals that are divided into sixteen first driving current signals, sixteen second driving current signals and sixteen third driving current signals. The scan driver 24 is connected to the signal processor 22 and the control circuit 25, and is operable to generate or not to generate the scan driving output based on the scan enable signal from the control circuit 25. The scan driving output is generated based on the scan control output from the signal processor 22, and includes thirty-two scan driving signals. The channel driver 23 of each of the shared driving circuits ($\mathbf{2}_1$-$\mathbf{2}_3$) is connected to the first to third channel lines ($Cr_1$-$Cr_{16}$, $Cg_1$-$Cg_{16}$, $Cb_1$-$Cb_{16}$) of the respective one of the channel line units ($\mathbf{5}_1$-$\mathbf{5}_3$) for providing the first to third driving current signals respectively thereto. The scan driver 24 of each of the shared driving circuits ($\mathbf{2}_1$-$\mathbf{2}_3$) is connected to the scan lines ($S_1$-$S_{32}$) of the respective one of the scan line units ($\mathbf{4}_1$-$\mathbf{4}_3$) for providing the scan driving signals respectively thereto.

Figure 6:
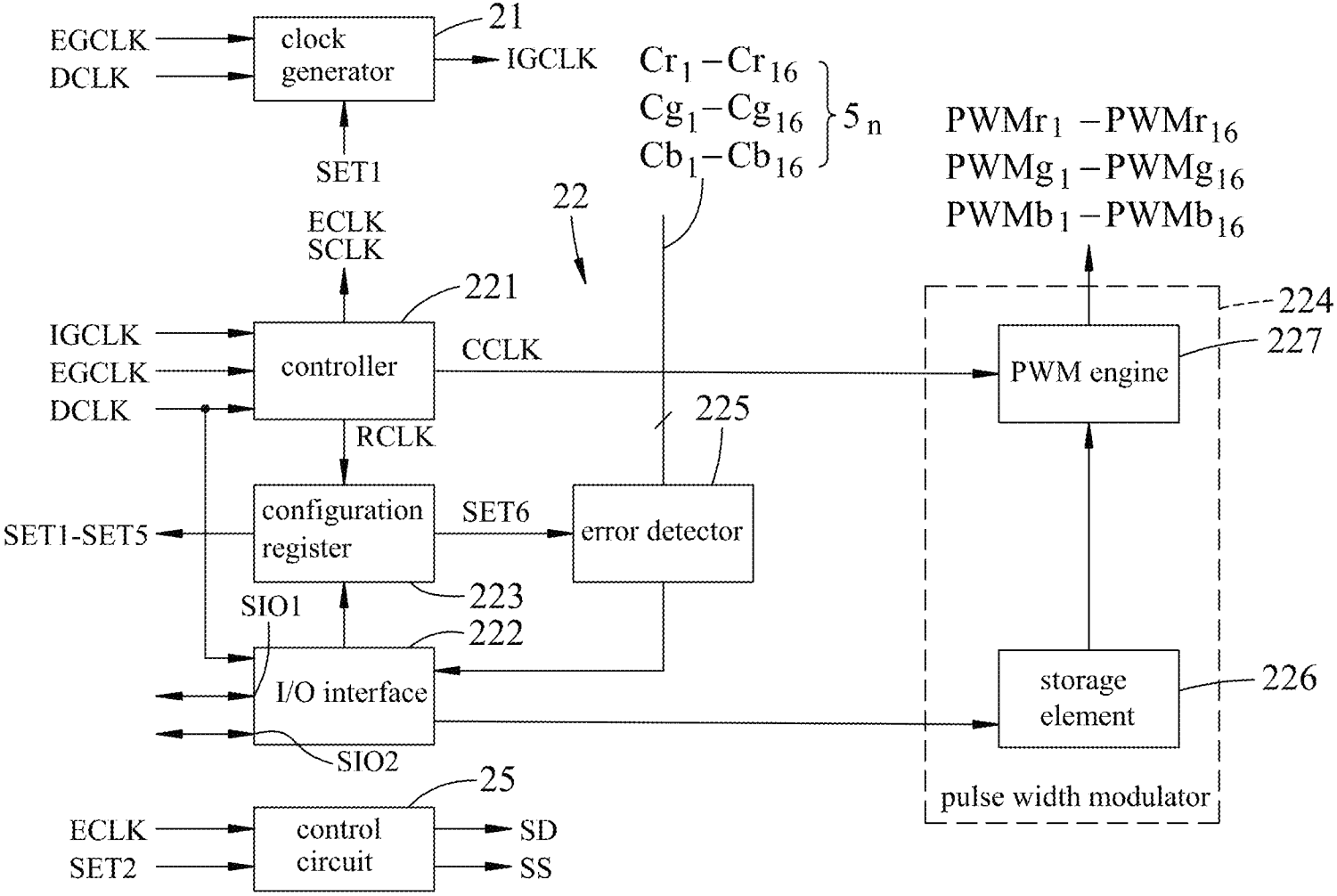
FIG. 6 is a block diagram illustrating a signal processor of the shared driving circuit of the first embodiment.

Referring to FIGS. 2 and 6, in this embodiment, the clock generator 21 is for receiving, from a central control system (not shown), an external global clock signal (EGCLK) and a data clock signal (DCLK) that have different frequencies and that are asynchronous to each other, and is for further receiving a source control setting (SET1). The clock generator 21 selects one of the external global clock signal (EGCLK) and the data clock signal (DCLK) based on the source control setting (SET1) to serve as the reference clock signal, and generates, based on the reference clock signal, the internal global clock signal (IGCLK) with a frequency that is a multiple of a frequency of the reference clock signal.

The clock generator 21 may be one of a phase-locked loop (PLL) and a delay-locked loop (DLL). In this embodiment, the clock generator 21 is a DLL, and the frequency of the internal global clock signal (IGCLK) is 80 MHz. It should be noted that the DLL may be a mixed-signal component or an all-digital component.

In this embodiment, the signal processor 22 includes a controller 221, an input/output (I/O) interface 222, a configuration register 223, a pulse width modulator 224 and an error detector 225.

The controller 221 is connected to the clock generator 21 for receiving the internal global clock signal (IGCLK) therefrom, and is for further receiving the external global clock signal (EGCLK) and the data clock signal (DCLK) from the central control system. The controller 221 generates a channel clock signal (CCLK), a scan clock signal (SCLK) and an enable clock signal (ECLK) in synchrony with one of the internal global clock signal (IGCLK) and the external global clock signal (EGCLK), and generates a configuration clock signal (RCLK) in synchrony with the data clock signal (DCLK).

The I/O interface 222 includes a first serial I/O pin (SIO1), a second serial I/O pin (SIO2), and a 16-bit bi-directional shift register (not shown) that is connected between the first and second serial I/O pins (SIO1, SIO2). The I/O interface 222 is for receiving the data clock signal (DCLK) from the central control system, and is for further receiving, from the central control system or the I/O interface 222 of the shared driving circuit at the previous stage, the display data and a plurality of control settings one bit at a time at the first serial I/O pin (SIO1) in synchrony with the data clock signal (DCLK). The I/O interface 222 outputs the display data and the control settings sixteen bits at a time, and further outputs the display data and the control settings one bit at a time at the second serial I/O pin (SIO2) for receipt by the I/O interface 222 of the shared driving circuit at the next stage, if any.

The configuration register 223 is connected to the controller 221 for receiving the configuration clock signal (RCLK) therefrom, and is further connected to the I/O interface 222 for receiving and storing the control settings therefrom sixteen bits at a time in synchrony with the configuration clock signal (RCLK). In this embodiment, the configuration register 223 includes a plurality of 16-bit fields for storing the control settings; and the control settings include the source control setting (SET1), an enable control setting (SET2), a current gain control setting (SET3), a reference voltage control setting (SET4), a scan control setting (SET5) and an error detection control setting (SET6). The configuration register 223 is further connected to the clock generator 21 for providing the source control setting (SET1) thereto.

The pulse width modulator 224 includes a storage element 226 and a pulse width modulation (PWM) engine 227. The storage element 226 is connected to the I/O interface 222 for receiving and storing the display data therefrom sixteen bits at a time. The storage element 226 may be a static random access memory (SRAM), a dynamic random access memory (DRAM), a register file that includes a plurality of D flip-flops, or the like. In this embodiment, the display data contains forty-eight-by-thirty-two 16-bit grey scale values that respectively correspond to the LEDs 321-323 (see FIG. 4) of a predetermined one of the light emitting arrays $\mathbf{3}_{1,1}$-$\mathbf{3}_{3,3}$; and the storage element 226 is a ping-pong SRAM with a capacity of 48K bits, and stores all of these grey scale values. The PWM engine 227 is connected to the controller 221 for receiving the channel clock signal (CCLK) therefrom, and is further connected to the storage element 226 for receiving therefrom forty-eight of the grey scale values that respectively correspond to the LEDs 321-323 (see FIG. 4) of the light emitting elements 32 (see FIG. 3) in a predetermined one of the rows. The PWM engine 227 performs pulse width modulation (PWM) based on the received grey scale values in synchrony with the channel clock signal (CCLK) to generate forty-eight PWM signals ($PWMr_1$-$PWMr_{16}$, $PWMg_1$-$PWMg_{16}$, $PWMb_1$-$PWMb_{16}$) that are divided into sixteen first PWM signals ($PWMr_1$-$PWMr_{16}$), sixteen second PWM signals ($PWMg_1$-$PWMg_{16}$) and sixteen third PWM signals ($PWMb_1$-$PWMb_{16}$). The first PWM signals ($PWMr_1$-$PWMr_{16}$) respectively correspond to the first driving current signals, and each has a pulse width related to the grey scale value that corresponds to a respective one of the red LEDs 321 (see FIG. 4) of the light emitting elements 32 (see FIG. 3) in the predetermined one of the rows. The second PWM signals ($PWMg_1$-$PWMg_{16}$) respectively correspond to the second driving current signals, and each has a pulse width related to the grey scale value that corresponds to a respective one of the green LEDs 322 (see FIG. 4) of the light emitting elements 32 (see FIG. 3) in the predetermined one of the rows. The third PWM signals ($PWMb_1$-$PWMb_{16}$) respectively correspond to the third driving current signals, and each has a pulse width related to the grey scale value that corresponds to a respective one of the blue LEDs 323 (see FIG. 4) of the light emitting elements 32 (FIG. 3) in the predetermined one of the rows.

The channel control output includes the first to third PWM signals ($PWMr_1$-$PWMr_{16}$, $PWMg_1$-$PWMg_{16}$, $PWMb_1$-$PWMb_{16}$) that are generated by the PWM engine 227, and the current gain control setting (SET3) and the reference voltage control setting (SET4) that are stored in the configuration register 223. The scan control output includes the scan clock signal (SCLK) that is generated by the controller 221, and the scan control setting (SET5) that is stored in the configuration register 223. The enable control output includes the enable clock signal (ECLK) that is generated by the controller 221, and the enable control setting (SET2) that is stored in the configuration register 223.

In this embodiment, the control circuit 25 is connected to the controller 221 and the configuration register 223 for receiving the enable clock signal (ECLK) and the enable control setting (SET2) respectively therefrom, and generates the channel enable signal (SD) and the scan enable signal (SS) based on the enable control setting (SET2) in synchrony with the enable clock signal (ECLK). Each of the channel enable signal (SD) and the scan enable signal (SS) is switchable between an active state (e.g., being at a logic "1" level) and an inactive state (e.g., being at a logic "0" level). The control circuit 25 may be implemented using a counter, a finite-state machine, a register circuit and a combinational logic circuit.

Figure 7:
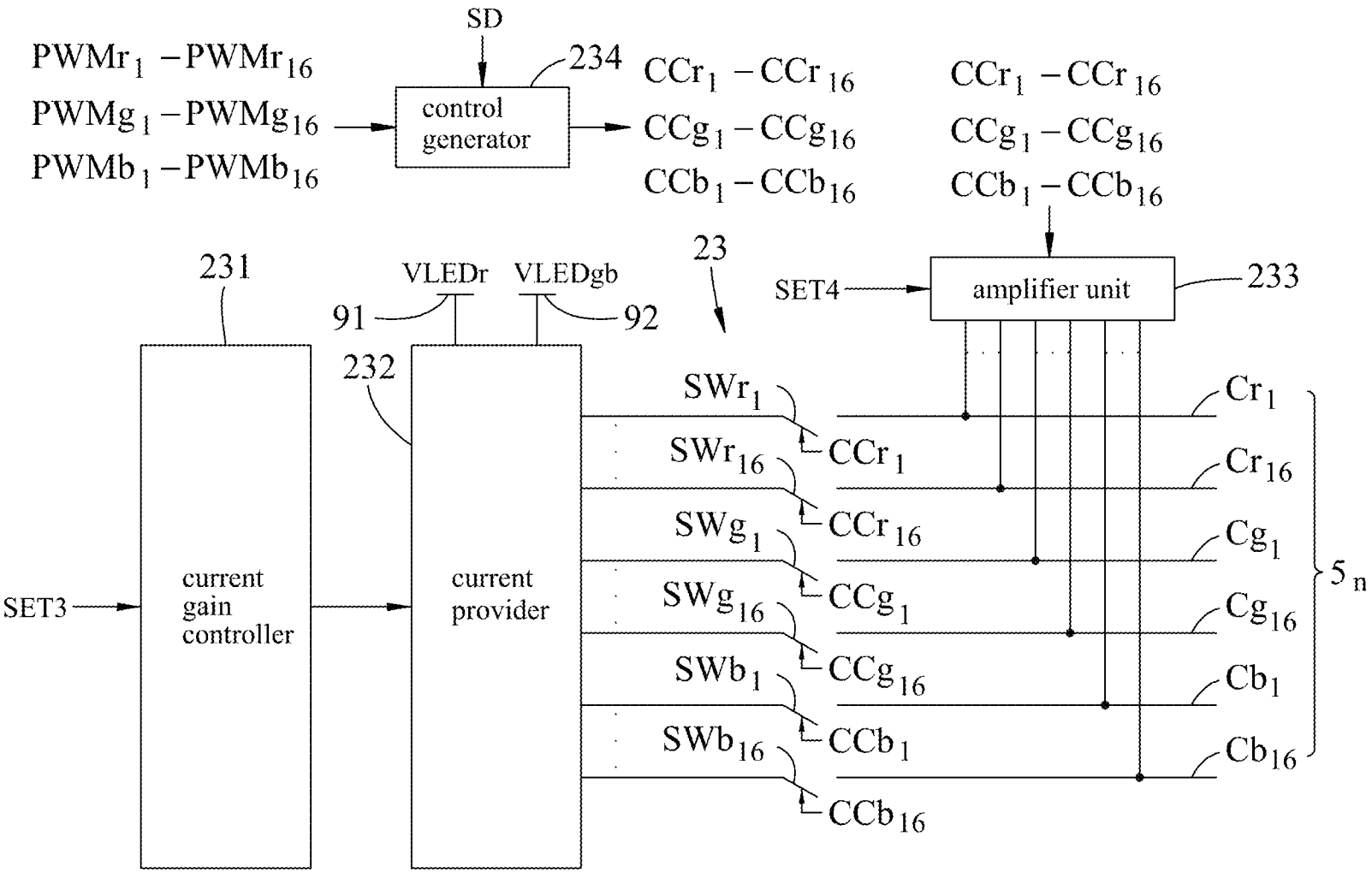
FIG. 7 is a circuit block diagram illustrating a channel driver of the shared driving circuit of the first embodiment.

Referring to FIG. 7, in this embodiment, the channel driver 23 includes a current gain controller 231, a current provider 232, a plurality of channel switches ($SWr_1$-$SWr_{16}$, $SWg_1$-$SWg_{16}$, $SWb_1$-$SWb_{16}$), an amplifier unit 233 and a control generator 234.

The control generator 234 is connected to the control circuit 25 (see FIG. 6) for receiving the channel enable signal (SD) therefrom, is further connected to the PWM engine 227 (see FIG. 6) for receiving the first to third PWM signals ($PWMr_1$-$PWMr_{16}$, $PWMg_1$-$PWMg_{16}$, $PWMb_1$-$PWMb_{16}$) therefrom, and generates forty-eight channel control signals ($CCr_1$-$CCr_{16}$, $CCg_1$-$CCg_{16}$, $CCb_1$-$CCb_{16}$) based on the channel enable signal (SD) and the first to third PWM signals ($PWMr_1$-$PWMr_{16}$, $PWMg_1$-$PWMg_{16}$, $PWMb_1$-$PWMb_{16}$). The channel control signals ($CCr_1$-$CCr_{16}$, $CCg_1$-$CCg_{16}$, $CCb_1$-$CCb_{16}$) are divided into sixteen first channel control signals ($CCr_1$-$CCr_{16}$) that respectively correspond to the first driving current signals, sixteen second channel control signals ($CCg_1$-$CCg_{16}$) that respectively correspond to the second driving current signals, and sixteen third channel control signals ($CCb_1$-$CCb_{16}$) that respectively correspond to the third driving current signals. For each of the first to third driving current signals, the control generator 234 outputs one of the first to third PWM signals ($PWMr_1$-$PWMr_{16}$, $PWMg_1$-$PWMg_{16}$, $PWMb_1$-$PWMb_{16}$) that corresponds to the driving current signal to serve as one of the first to third channel control signals ($CCr_1$-$CCr_{16}$, $CCg_1$-$CCg_{16}$, $CCb_1$-$CCb_{16}$) that corresponds to the driving current signal when the channel enable signal (SD) is in the active state, and outputs a predetermined reference voltage with a magnitude corresponding to non-conduction of the channel switches ($SWr_1$-$SWr_{16}$, $SWg_1$-$SWg_{16}$, $SWb_1$-$SWb_{16}$) to serve as the one of the first to third channel control signals ($CCr_1$-$CCr_{16}$, $CCg_1$-$CCg_{16}$, $CCb_1$-$CCb_{16}$) when the channel enable signal (SD) is in the inactive state.

The current gain controller 231 is connected to the configuration register 223 (see FIG. 6) for receiving the current gain control setting (SET3) therefrom, and generates, based on the current gain control setting (SET3), a current gain control output that includes a first current gain control signal, a second current gain control signal and a third current gain control signal.

The current provider 232 is connected to the current gain controller 231 for receiving the first to third current gain control signals therefrom, is adapted to be further connected to a first power rail 91 for receiving therefrom a first supply voltage (VLEDr) with a magnitude that falls within a range of 2.4V to 4.5V, and is adapted to be further connected to a second power rail 92 for receiving therefrom a second supply voltage (VLEDgb) with a magnitude that falls within a range of 3.2V to 4.5V. The current provider 232 provides forty-eight driving currents that are divided into sixteen first driving currents, sixteen second driving currents and sixteen third driving currents. The first driving currents are sourced from the first power rail 91. The second and third driving currents are sourced from the second power rail 92. The current provider 232 further adjusts magnitudes of the first driving currents based on the first current gain control signal, adjusts magnitudes of the second driving currents based on the second current gain control signal, and adjusts magnitudes of the third driving currents based on the third current gain control signal.

The channel switches ($SWr_1$-$SWr_{16}$, $SWg_1$-$SWg_{16}$, $SWb_1$-$SWb_{16}$) are divided into sixteen first channel switches ($SWr_1$-$SWr_{16}$) that respectively correspond to the first driving current signals, sixteen second channel switches ($SWg_1$-$SWg_{16}$) that respectively correspond to the second driving current signals, and sixteen third channel switches ($SWb_1$-$SWb_{16}$) that respectively correspond to the third driving current signals. Each of the first to third channel switches ($SWr_1$-$SWr_{16}$, $SWg_1$-$SWg_{16}$, $SWb_1$-$SWb_{16}$) has a first terminal that is connected to the current provider 232, a second terminal that is for providing the respective one of the first to third driving current signals, and a control terminal that is connected to the control generator 234 for receiving therefrom one of the first to third channel control signals ($CCr_1$-$CCr_{16}$, $CCg_1$-$CCg_{16}$, $CCb_1$-$CCb_{16}$) which corresponds to the respective one of the first to third driving current signals. Each of the first channel switches ($SWr_1$-$SWr_{16}$) permits a respective one of the first driving currents to flow therethrough when conducting. Each of the second channel switches ($SWg_1$-$SWg_{16}$) permits a respective one of the second driving currents to flow therethrough when conducting. Each of the third channel switches ($SWb_1$-$SWb_{16}$) permits a respective one of the third driving currents to flow therethrough when conducting.

Therefore, when the channel enable signal (SD) is in the active state, the first to third channel switches ($SWr_1$-$SWr_{16}$, $SWg_1$-$SWg_{16}$, $SWb_1$-$SWb_{16}$) transition between conduction and non-conduction, the first to third driving current signals are generated, and a magnitude of each of the first to third driving current signals is equal to the magnitude of a corresponding one of the first to third driving currents in a case where a corresponding one of the first to third channel switches ($SWr_1$-$SWr_{16}$, $SWg_1$-$SWg_{16}$, $SWb_1$-$SWb_{16}$) conducts, and is zero otherwise. When the channel enable signal (SD) is in the inactive state, none of the first to third channel switches ($SWr_1$-$SWr_{16}$, $SWg_1$-$SWg_{16}$, $SWb_1$-$SWb_{16}$) conducts, and the first to third driving current signals are not generated.

The amplifier unit 233 is connected to the second terminals of the first to third channel switches ($SWr_1$-$SWr_{16}$, $SWg_1$-$SWg_{16}$, $SWb_1$-$SWb_{16}$), is further connected to the configuration register 223 (see FIG. 6) for receiving the reference voltage control setting (SET4) therefrom, and is further connected to the control generator 234 for receiving the first to third channel control signals ($CCr_1$-$CCr_{16}$, $CCg_1$-$CCg_{16}$, $CCb_1$-$CCb_{16}$) therefrom. For each of the first channel switches ($SWr_1$-$SWr_{16}$), the amplifier unit 233 adjusts a magnitude of a voltage at the second terminal of the first channel switch to a first reference voltage value based on the reference voltage control setting (SET4) when one of the first channel control signals ($CCr_1$-$CCr_{16}$) that is received by the first channel switch causes the first channel switch to not conduct. For each of the second channel switches ($SWg_1$-$SWg_{16}$), the amplifier unit 233 adjusts a magnitude of a voltage at the second terminal of the second channel switch to a second reference voltage value based on the reference voltage control setting (SET4) when one of the second channel control signals ($CCg_1$-$CCg_{16}$) that is received by the second channel switch causes the second channel switch to not conduct. For each of the third channel switches ($SWb_1$-$SWb_{16}$), the amplifier unit 233 adjusts a magnitude of a voltage at the second terminal of the third channel switch to a third reference voltage value based on the reference voltage control setting (SET4) when one of the third channel control signals ($CCb_1$-$CCb_{16}$) that is received by the third channel switch causes the third channel switch to not conduct. As a consequence, non-ideal effects such as lower ghosting, dark lines and coupling can be eliminated.

Figure 8:
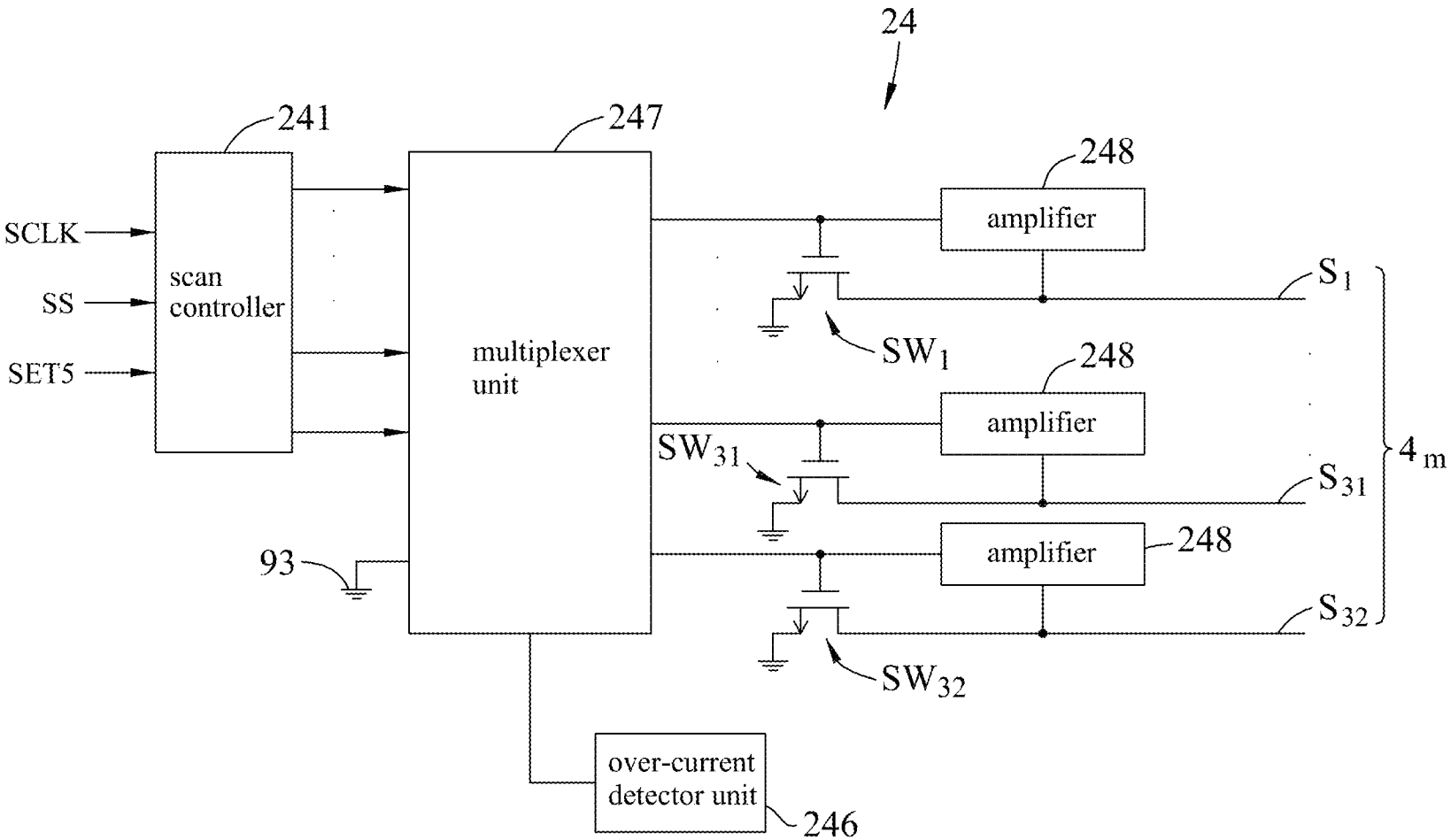
FIG. 8 is a circuit block diagram illustrating a scan driver of the shared driving circuit of the first embodiment.

Referring to FIG. 8, in the first embodiment, the scan driver 24 includes a scan controller 241, a multiplexer unit 247, thirty-two scan switches ($SW_1$-$SW_{32}$), thirty-two amplifiers 248 and an over-current detector unit 246.

The scan controller 241 is connected to the controller 221 (see FIG. 6) for receiving the scan clock signal (SCLK) therefrom, is further connected to the configuration register 223 (see FIG. 6) for receiving the scan control setting (SET5) therefrom, and is further connected to the control circuit 25 (see FIG. 6) for receiving the scan enable signal (SS) therefrom. The scan controller 241 generates thirty-two scan control signals (which respectively correspond to the scan driving signals) based on the scan clock signal (SCLK), the scan control setting (SET5) and the scan enable signal (SS) in such a way that: (a) when the scan enable signal (SS) is in the active state, at least some of the scan control signals transition between two different logical states, which respectively correspond to conduction and non-conduction of the scan switches ($SW_1$-$SW_{32}$), in synchrony with the scan clock signal (SCLK), remaining one(s), if any, of the scan control signals is(are) in one of the logical states which corresponds to non-conduction of the scan switches ($SW_1$-$SW_{32}$), and a number of the at least some of the scan control signals is related to the scan control setting (SET5); and (b) when the scan enable signal (SS) is in the inactive state, all of the scan control signals are in the one of the logical states which corresponds to non-conduction of the scan switches ($SW_1$-$SW_{32}$).

The multiplexer unit 247 is connected to the scan controller 241 for receiving the scan control signals therefrom, is adapted to be further connected to a third power rail 93 for receiving a ground voltage therefrom, is for further receiving thirty-two indication signals that respectively correspond to the scan driving signals, and generates thirty-two switch control signals that respectively correspond to the scan driving signals. For each of the scan driving signals, the multiplexer unit 247 outputs one of the ground voltage and the scan control signal corresponding to the scan driving signal based on the indication signal corresponding to the scan driving signal to serve as the switch control signal corresponding to the scan driving signal.

Each of the scan switches ($SW_1$-$SW_{32}$) (e.g., an N-type power semiconductor transistor) has a first terminal (e.g., a drain terminal) that is for providing a respective one of the scan driving signals, a second terminal (e.g., a source terminal) that is adapted to be connected to the third power rail 93 for receiving the ground voltage therefrom, and a control terminal (e.g., a gate terminal) that is connected to the multiplexer unit 247 for receiving therefrom one of the switch control signals which corresponds to the respective one of the scan driving signals.

Each of the amplifiers 248 is connected to the first terminal of a respective one of the scan switches ($SW_1$-$SW_{32}$), and is further connected to the multiplexer unit 247 for receiving therefrom one of the switch control signals that is received by the respective one of the scan switches ($SW_1$-$SW_{32}$). Each of the amplifiers 248 adjusts a magnitude of a voltage at the first terminal of the respective one of the scan switches ($SW_1$-$SW_{32}$) to a predetermined reference voltage value when the one of the switch control signals causes the respective one of the scan switches ($SW_1$-$SW_{32}$) to not conduct. As a consequence, upper ghosting can be eliminated.

Figure 9:
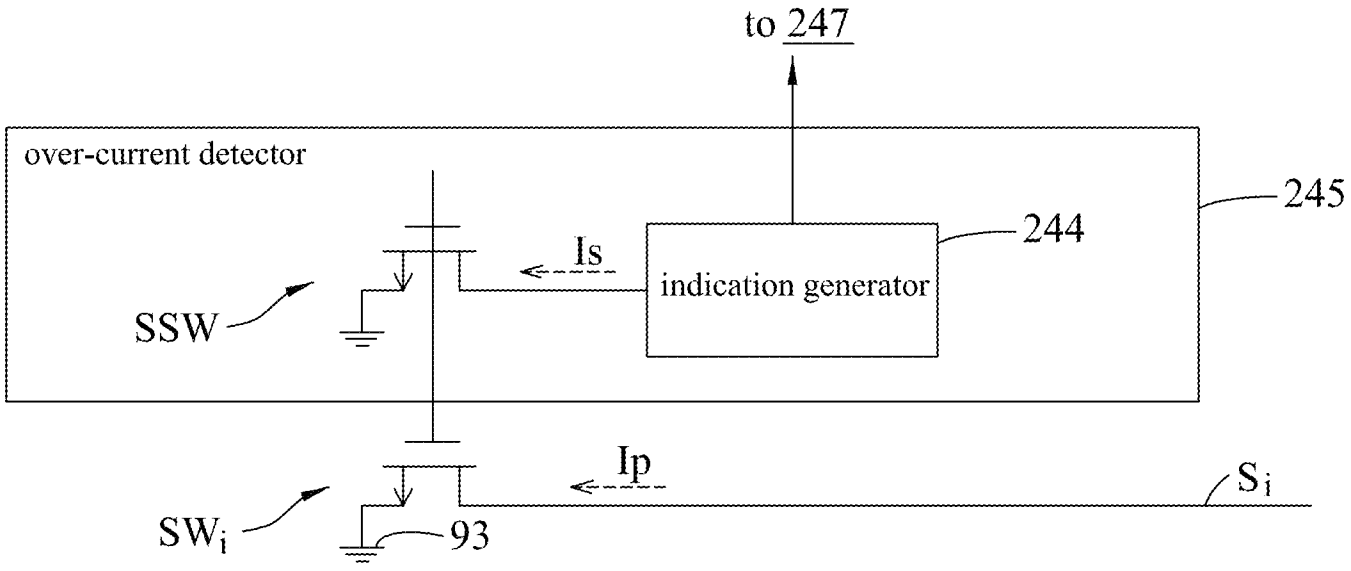
FIG. 9 is a circuit block diagram illustrating an overcurrent detector of the scan driver of the first embodiment.

Referring to FIGS. 8 and 9, the over-current detector unit 246 includes thirty-two over-current detectors 245. Each of the over-current detectors 245 includes a detector switch (SSW) and an indication generator 244. The detector switch (SSW) (e.g., an N-type power semiconductor transistor) has a first terminal (e.g., a drain terminal), a second terminal (e.g., a source terminal) that is connected to the second terminal of a respective one of the scan switches ($SW_1$-$SW_{32}$), and a control terminal (e.g., a gate terminal) that is connected to the control terminal of the respective one of the scan switches ($SW_1$-$SW_{32}$). The detector switch (SSW) has a size that is about one-thousandth of a size of the respective one of the scan switches ($SW_1$-$SW_{32}$), so a current (Is) flowing therethrough has a magnitude that is about one-thousandth of a magnitude of a current (Ip) flowing through the respective one of the scan switches ($SW_1$-$SW_{32}$). The indication generator 244 is connected to the first terminal of the detector switch (SSW), is further connected to the multiplexer unit 247, and generates, based on the current (Is) for receipt by the multiplexer unit 247, one of the indication signals that corresponds to one of the scan driving signals which is provided by the respective one of the scan switches ($SW_1$-$SW_{32}$). The one of the indication signals indicates whether the magnitude of the current (Ip) is greater than a predetermined rated current value. For each of the scan driving signals, the multiplexer unit 247 outputs the ground voltage to serve as the switch control signal corresponding to the scan driving signal when the indication signal corresponding to the scan driving signal indicates that the magnitude of the current (Ip) is greater than the predetermined rated current value, and outputs the scan control signal corresponding to the scan driving signal to serve as the switch control signal corresponding to the scan driving signal otherwise. As a consequence, each of the scan switches ($SW_1$-$SW_{32}$) is forced to not conduct when it is detected to be undergoing current overflow, thereby achieving over-current protection.

Therefore, when the scan enable signal (SS) is in the active state, the at least some of the scan switches ($SW_1$-$SW_{32}$) transition between conduction and non-conduction, the scan driving signals are generated, and each of the scan driving signals ties the first terminal of a corresponding one of the scan switches ($SW_1$-$SW_{32}$) to the ground voltage in a case where the corresponding one of the scan switches ($SW_1$-$SW_{32}$) conducts, and does not tie the first terminal of the corresponding one of the scan switches ($SW_1$-$SW_{32}$) to the ground voltage otherwise. When the scan enable signal (SS) is in the inactive state, none of the scan switches ($SW_1$-$SW_{32}$) conducts, and the scan driving signals are not generated.

Referring back to FIGS. 6 and 7, the error detector 225 is connected to the configuration register 223 for receiving the error detection control setting (SET6) therefrom, and is further connected to the second terminals of the first to third channel switches ($SWr_1$-$SWr_{16}$, $SWg_1$-$SWg_{16}$, $SWb_1$-$SWb_{16}$) and the I/O interface 222. The error detector 225 generates a first threshold voltage, a second threshold voltage and a third threshold voltage based on the error detection control setting (SET6). The first to third threshold voltages may have the same magnitude or different magnitudes. For each of the first channel switches ($SWr_1$-$SWr_{16}$), the error detector 225 compares the voltage at the second terminal of the first channel switch with the first threshold voltage to generate a respective first comparison signal that is at the logic "1" level when the voltage at the second terminal of the first channel switch is greater than the first threshold voltage in magnitude, and that is at the logic "0" level otherwise. For each of the second channel switches ($SWg_1$-$SWg_{16}$), the error detector 225 compares the voltage at the second terminal of the second channel switch with the second threshold voltage to generate a respective second comparison signal that is at the logic "1" level when the voltage at the second terminal of the second channel switch is greater than the second threshold voltage in magnitude, and that is at the logic "0" level otherwise. For each of the third channel switches ($SWb_1$-$SWb_{16}$), the error detector 225 compares the voltage at the second terminal of the third channel line with the third threshold voltage to generate a respective third comparison signal that is at the logic "1" level when the voltage at the second terminal of the third channel switch is greater than the third threshold voltage in magnitude, and that is at the logic "0" level otherwise. When the error detection control setting (SET6) is set to detect LED open circuit failures, the logic "1" level indicates that an LED open circuit failure is detected, and the logic "0" level indicates that an LED open circuit failure is not detected. When the error detection control setting (SET6) is set to detect LED short circuit failures, the logic "1" level indicates that an LED short circuit failure is not detected, and the logic "0" level indicates that an LED short circuit failure is detected. The error detector 225 outputs the first to third comparison signals one bit at a time for receipt by the I/O interface 222, and the I/O interface 222 outputs the first to third comparison signals from the error detector 225 one bit at a time at the first serial I/O pin (SIO1) for receipt by the central control system or the I/O interface 222 of the shared driving circuit at the previous stage. The I/O interface 222 is for further receiving the first to third comparison signals from the I/O interface 222 of the shared driving circuit at the next stage, if any, one bit at a time at the second serial I/O pin (SIO2), and outputs the first to third comparison signals thus received one bit at a time at the first serial I/O pin (SIO1) for receipt by the central control system or the I/O interface 222 of the shared driving circuit at the previous stage.

Referring to FIGS. 2, 5 and 6, it should be noted that, in a modification of this embodiment, each of the shared driving circuit $\mathbf{2}_1$-$\mathbf{2}_3$ may further include a power saving unit (not shown); the configuration register 223 may further store a grey scale control setting that contains a grey scale threshold; the power saving unit may be connected to the configuration register 223 for receiving the grey scale control setting therefrom, may be further connected to the storage element 226 for receiving therefrom the forty-eight of the grey scale values that respectively correspond to the LEDs 321-323 (see FIG. 4) of the light emitting elements 32 (see FIG. 3) in the predetermined one of the rows, and may be further connected to the channel driver 23; when all of the received grey scale values are zero, the power saving unit may disable all analog circuits of the current gain controller 231 (see FIG. 7) and all analog circuits of the current provider 232 (see FIG. 7) to reduce power consumption; and when at least one of the received grey scale values is non-zero, for each of the first to third driving current signals, the power saving unit may disable some of the analog circuits of the current gain controller 231 (see FIG. 7) and the current provider 232 (see FIG. 7) that are related to the driving current signal after one of the first to third channel switches ($SWr_1$-$SWr_{16}$, $SWg_1$-$SWg_{16}$, $SWb_1$-$SWb_{16}$) that is for providing the driving current signal transitions to non-conduction in a case where one of the received grey scale values that corresponds to the driving current signal is smaller than the grey scale threshold, so as to reduce power consumption.

Figure 10:
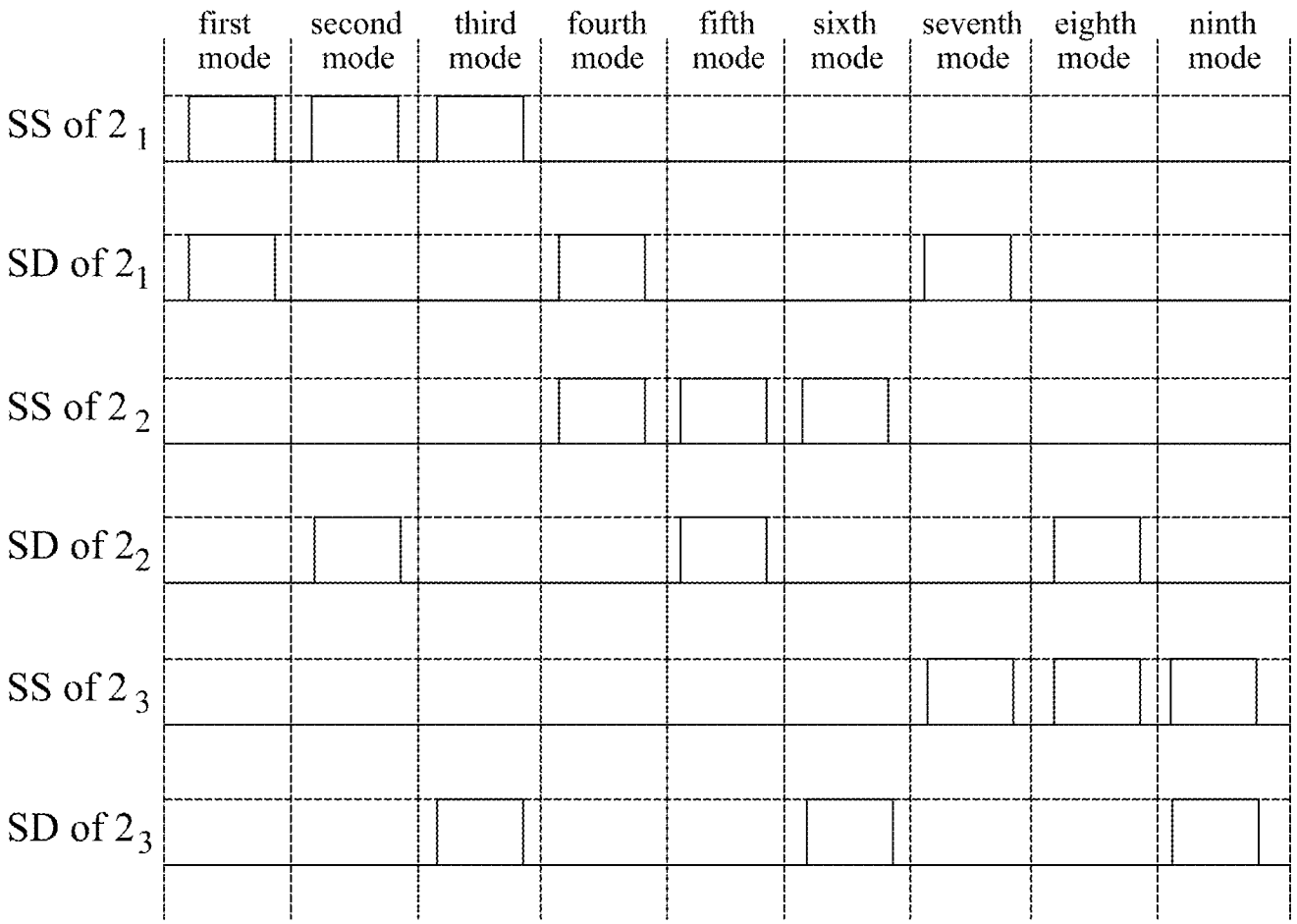
FIG. 10 is a timing diagram illustrating operations of the first embodiment.

Referring to FIGS. 2 and 10, in this embodiment, the enable control setting received by the shared driving circuit $\mathbf{2}_1$ indicates that there are first to ninth modes, that the scan driving output should be generated in the first to third modes, and that the channel driving output should be generated in the first, fourth and seventh modes. The enable control setting received by the shared driving circuit $\mathbf{2}_2$ indicates that there are first to ninth modes, that the scan driving output should be generated in the fourth to sixth modes, and that the channel driving output should be generated in the second, fifth and eighth modes. The enable control setting received by the shared driving circuit $\mathbf{2}_3$ indicates that there are first to ninth modes, that the scan driving output should be generated in the seventh to ninth modes, and that the channel driving output should be generated in the third, sixth and ninth modes. Based on these enable control settings, the display system operates cyclically in the first to ninth modes.

In the first mode, the scan enable signal (SS) and the channel enable signal (SD) of the shared driving circuit $\mathbf{2}_1$ are in the active state for a predetermined time period, and the scan enable signals (SS) and the channel enable signals (SD) of the shared driving circuits $\mathbf{2}_2$, $\mathbf{2}_3$ are in the inactive state, so the light emitting array $\mathbf{3}_{1,1}$ is driven by the scan driving output and the channel driving output from the shared driving circuit $\mathbf{2}_1$ to emit light for the predetermined time period.

In the second mode, the scan enable signal (SS) of the shared driving circuit $\mathbf{2}_1$ and the channel enable signal (SD) of the shared driving circuit $\mathbf{2}_2$ are in the active state for the predetermined time period, and the scan enable signals (SS) of the shared driving circuits $\mathbf{2}_2$, $\mathbf{2}_3$ and the channel enable signals (SD) of the shared driving circuits $\mathbf{2}_1$, $\mathbf{2}_3$ are in the inactive state, so the light emitting array $\mathbf{3}_{1,2}$ is driven by the scan driving output from the shared driving circuit $\mathbf{2}_1$ and the channel driving output from the shared driving circuit $\mathbf{2}_2$ to emit light for the predetermined time period.

In the third mode, the scan enable signal (SS) of the shared driving circuit $\mathbf{2}_1$ and the channel enable signal (SD) of the shared driving circuit $\mathbf{2}_3$ are in the active state for the predetermined time period, and the scan enable signals (SS) of the shared driving circuits $\mathbf{2}_2$, $\mathbf{2}_3$ and the channel enable signals (SD) of the shared driving circuits $\mathbf{2}_1$, $\mathbf{2}_2$ are in the inactive state, so the light emitting array $\mathbf{3}_{1,3}$ is driven by the scan driving output from the shared driving circuit $\mathbf{2}_1$ and the channel driving output from the shared driving circuit $\mathbf{2}_3$ to emit light for the predetermined time period.

In the fourth mode, the scan enable signal (SS) of the shared driving circuit $\mathbf{2}_2$ and the channel enable signal (SD) of the shared driving circuit $\mathbf{2}_1$ are in the active state for the predetermined time period, and the scan enable signals (SS) of the shared driving circuits $\mathbf{2}_1$, $\mathbf{2}_3$ and the channel enable signals (SD) of the shared driving circuits $\mathbf{2}_2$, $\mathbf{2}_3$ are in the inactive state, so the light emitting array $\mathbf{3}_{2,1}$ is driven by the scan driving output from the shared driving circuit $\mathbf{2}_2$ and the channel driving output from the shared driving circuit $\mathbf{2}_1$ to emit light for the predetermined time period.

In the fifth mode, the scan enable signal (SS) and the channel enable signal (SD) of the shared driving circuit $\mathbf{2}_2$ are in the active state for the predetermined time period, and the scan enable signals (SS) and the channel enable signals (SD) of the shared driving circuits $\mathbf{2}_1$, $\mathbf{2}_3$ are in the inactive state, so the light emitting array $\mathbf{3}_{2,2}$ is driven by the scan driving output and the channel driving output from the shared driving circuit $\mathbf{2}_2$ to emit light for the predetermined time period.

In the sixth mode, the scan enable signal (SS) of the shared driving circuit $\mathbf{2}_2$ and the channel enable signal (SD) of the shared driving circuit $\mathbf{2}_3$ are in the active state for the predetermined time period, and the scan enable signals (SS) of the shared driving circuits $\mathbf{2}_1$, $\mathbf{2}_3$ and the channel enable signals (SD) of the shared driving circuits $\mathbf{2}_1$, $\mathbf{2}_2$ are in the inactive state, so the light emitting array $\mathbf{3}_{2,3}$ is driven by the scan driving output from the shared driving circuit $\mathbf{2}_2$ and the channel driving output from the shared driving circuit $\mathbf{2}_3$ to emit light for the predetermined time period.

In the seventh mode, the scan enable signal (SS) of the shared driving circuit $\mathbf{2}_3$ and the channel enable signal (SD) of the shared driving circuit $\mathbf{2}_1$ are in the active state for the predetermined time period, and the scan enable signals (SS) of the shared driving circuits $\mathbf{2}_1$, $\mathbf{2}_2$ and the channel enable signals (SD) of the shared driving circuits $\mathbf{2}_2$, $\mathbf{2}_3$ are in the inactive state, so the light emitting array $\mathbf{3}_{3,1}$ is driven by the scan driving output from the shared driving circuit $\mathbf{2}_3$ and the channel driving output from the shared driving circuit $\mathbf{2}_1$ to emit light for the predetermined time period.

In the eighth mode, the scan enable signal (SS) of the shared driving circuit $2_3$ and the channel enable signal (SD) of the shared driving circuit $2_2$ are in the active state for the predetermined time period, and the scan enable signals (SS) of the shared driving circuits $2_1$, $2_2$ and the channel enable signals (SD) of the shared driving circuits $2_1$, $2_3$ are in the inactive state, so the light emitting array $3_{3,2}$ is driven by the scan driving output from the shared driving circuit $2_3$ and the channel driving output from the shared driving circuit $2_2$ to emit light for the predetermined time period.

In the ninth mode, the scan enable signal (SS) and the channel enable signal (SD) of the shared driving circuit $2_3$ are in the active state for the predetermined time period, and the scan enable signals (SS) and the channel enable signals (SD) of the shared driving circuits $2_1$, $2_2$ are in the inactive state, so the light emitting array $3_{3,3}$ is driven by the scan driving output and the channel driving output from the shared driving circuit $2_3$ to emit light for the predetermined time period.

It should be noted that, in each of the first to ninth modes, the current gain controllers 231 (see FIG. 7) and the current providers 232 (see FIG. 7) of the shared driving circuits each with the channel enable signal (SD) constantly in the inactive state during the mode can be disabled, so as to reduce power consumption.

It should also be noted that, in a modification of this embodiment, the enable control setting received by the shared driving circuit $2_1$ may indicate that there are first to third modes, that the scan driving output should be generated in the first mode, and that the channel driving output should be generated in the first to third modes. The enable control setting received by the shared driving circuit $2_2$ may indicate that there are first to third modes, that the scan driving output should be generated in the second mode, and that the channel driving output should be generated in the first to third modes. The enable control setting received by the shared driving circuit $2_3$ may indicate that there are first to third modes, that the scan driving output should be generated in the third modes, and that the channel driving output should be generated in the first to third modes. Based on these enable control settings, the display system may operate cyclically in the first to third modes. In the first mode, the scan enable signal (SS) of the shared driving circuit $2_1$ and the channel enable signals (SD) of the shared driving circuits $2_1$-$2_3$ may be in the active state for a predetermined time period, and the scan enable signals (SS) of the shared driving circuits $2_2$, $2_3$ may be in the inactive state, so the light emitting arrays $3_{1,1}$-$3_{1,3}$ may be driven by the scan driving output from the shared driving circuit $2_1$ and respectively by the channel driving outputs from the shared driving circuits $2_1$-$2_3$ to emit light for the predetermined time period. In the second mode, the scan enable signal (SS) of the shared driving circuit $2_2$ and the channel enable signals (SD) of the shared driving circuits $2_1$-$2_3$ may be in the active state for the predetermined time period, and the scan enable signals (SS) of the shared driving circuits $2_1$, $2_3$ may be in the inactive state, so the light emitting arrays $3_{2,1}$-$3_{2,3}$ may be driven by the scan driving output from the shared driving circuit $2_2$ and respectively by the channel driving outputs from the shared driving circuits $2_1$-$2_3$ to emit light for the predetermined time period. In the third mode, the scan enable signal (SS) of the shared driving circuit $2_3$ and the channel enable signals (SD) of the shared driving circuits $2_1$-$2_3$ may be in the active state for the predetermined time period, and the scan enable signals (SS) of the shared driving circuits $2_1$, $2_2$ may be in the inactive state, so the light emitting arrays $3_{3,1}$-$3_{3,3}$ may be driven by the scan driving output from the shared driving circuit $2_3$ and respectively by the channel driving outputs from the shared driving circuits $2_1$-$2_3$ to emit light for the predetermined time period.

Figure 11:
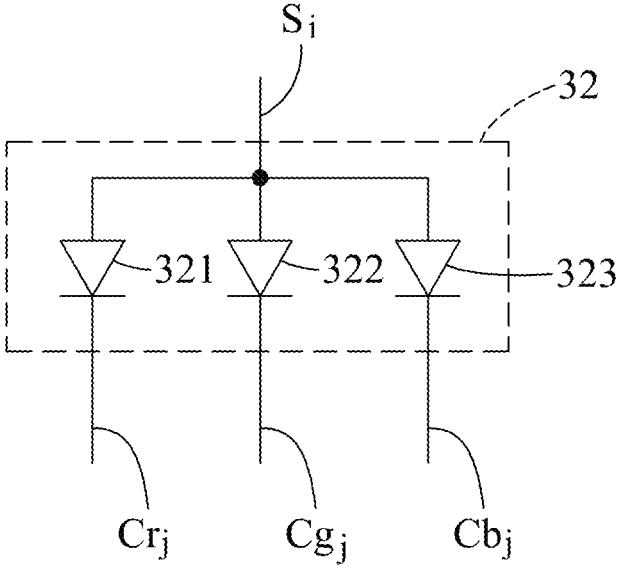
FIG. 11 is a circuit diagram illustrating a light emitting element of a light emitting array of a second embodiment of the display system according to the disclosure.

Referring to FIGS. 2, 3 and 11, a second embodiment of the display system according to the disclosure is similar to the first embodiment, but is different in what are described below.

In the second embodiment, in each of the light emitting arrays $3_{1,1}$-$3_{3,3}$, for each of the columns of the light emitting elements 32, the cathodes of the red LEDs 321 of the light emitting elements 32 are connected to the respective one of the first channel lines ($Cr_1$-$Cr_{16}$) of the channel line unit corresponding to the light emitting array, the cathodes of the green LEDs 322 of the light emitting elements 32 are connected to the respective one of the second channel lines ($Cg_1$-$Cg_{16}$) of the channel line unit corresponding to the light emitting array, and the cathodes of the blue LEDs 323 of the light emitting elements 32 are connected to the respective one of the third channel lines ($Cb_1$-$Cb_{16}$) of the channel line unit corresponding to the light emitting array; and for each of the rows of the light emitting elements 32, the anodes of the LEDs 321-323 of the light emitting elements 32 are connected to the respective one of the scan lines ($S_1$-$S_{32}$) of the scan line unit corresponding to the light emitting array. In other words, each of the LED arrays $3_{1,1}$-$3_{3,3}$ has a common anode configuration in this embodiment.

Figure 12:
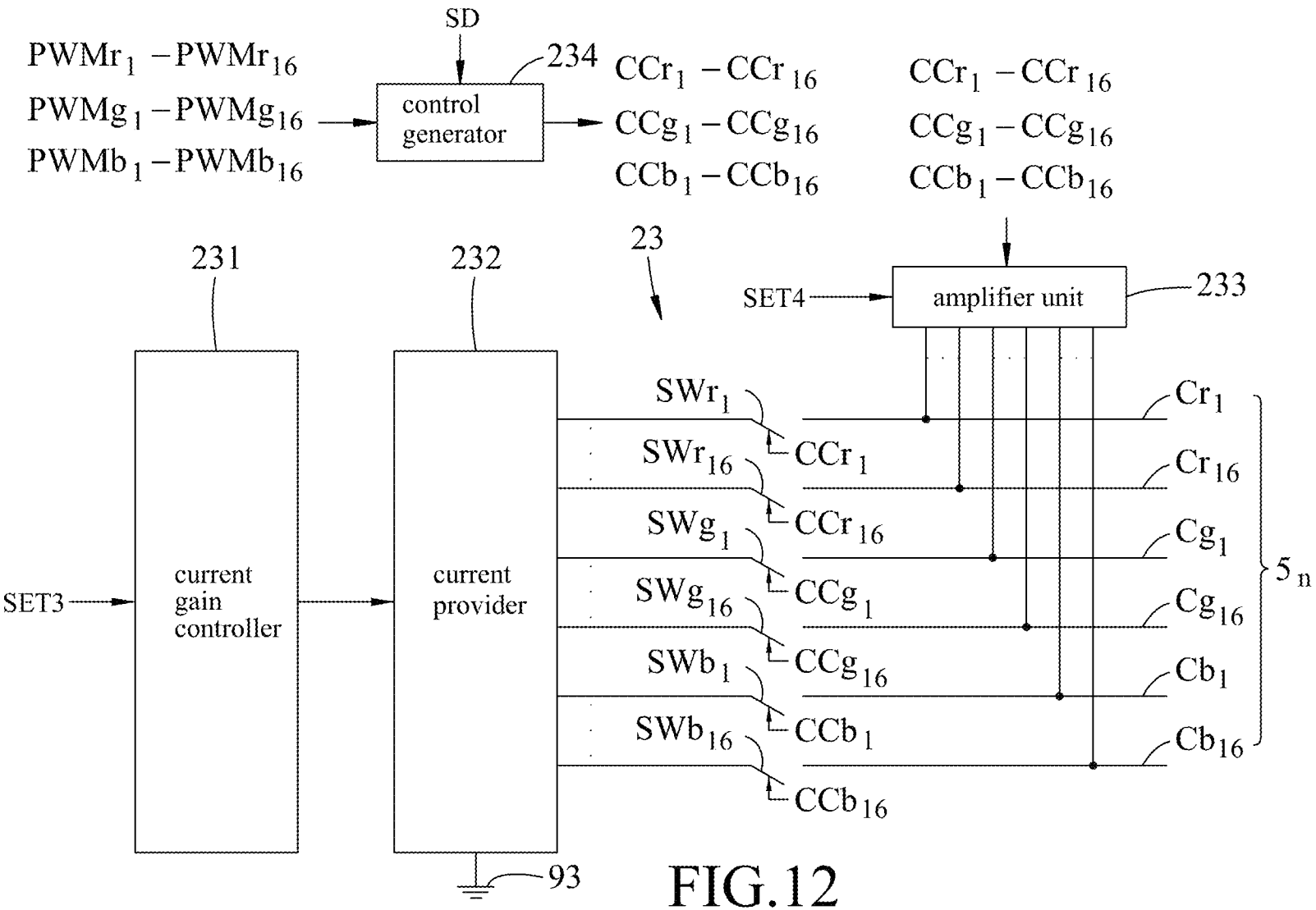
FIG. 12 is a circuit block diagram illustrating a channel driver of a shared driving circuit of the second embodiment.

Referring to FIG. 12, in each of the shared driving circuits $2_1$-$2_3$ (see FIG. 2), the current provider 232 is adapted to be connected to the third power rail 93 for receiving the ground voltage therefrom, instead of being connected to the first and second power rails 91, 92 (see FIG. 7) for receiving the first and second supply voltages (VLEDr, VLEDgb) (see FIG. 7) respectively therefrom; and the first to third driving currents are sunk to the third power rail 93.

Figure 13:
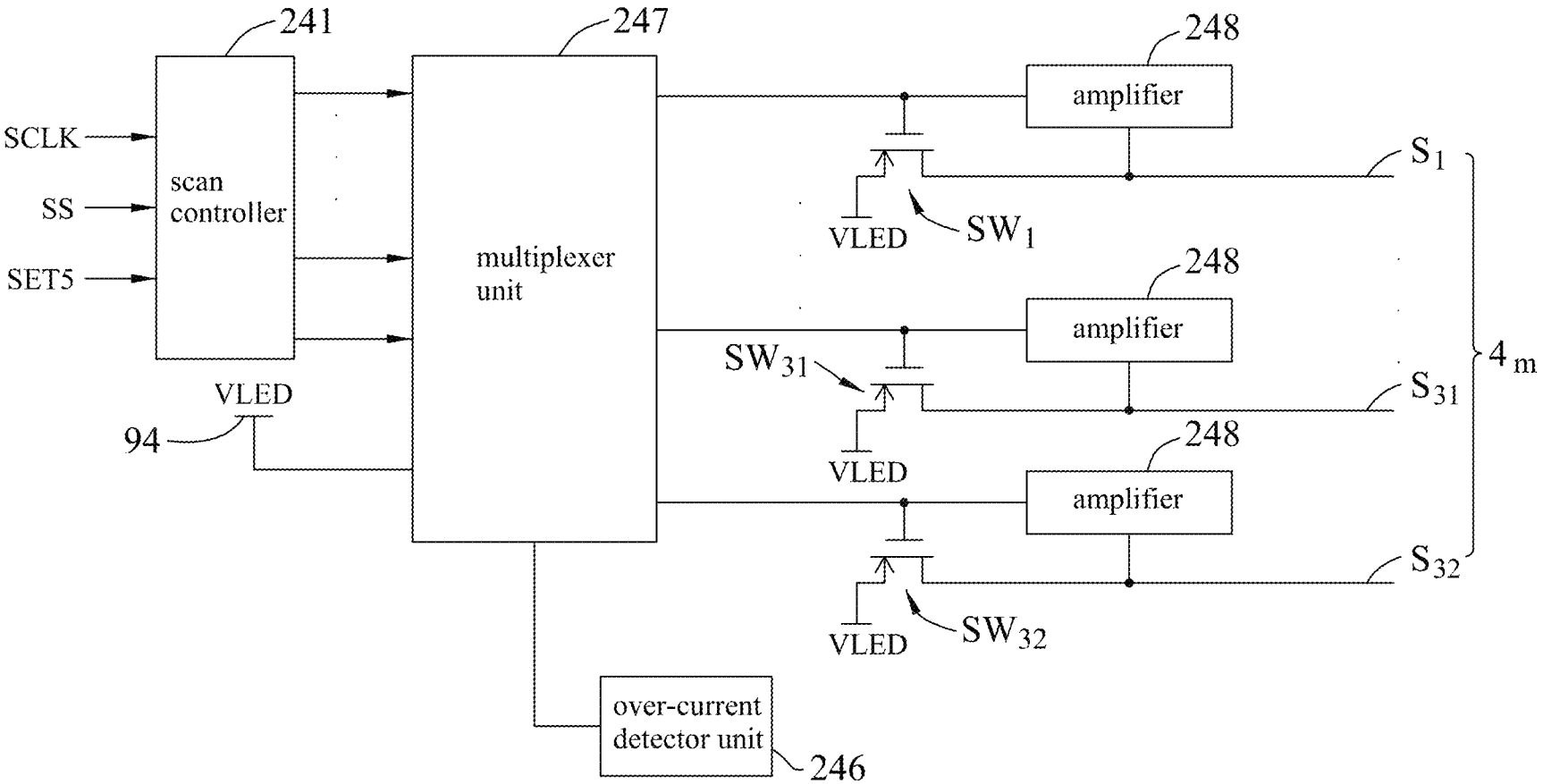
FIG. 13 is a circuit block diagram illustrating a scan driver of the shared driving circuit of the second embodiment.
Figure 14:
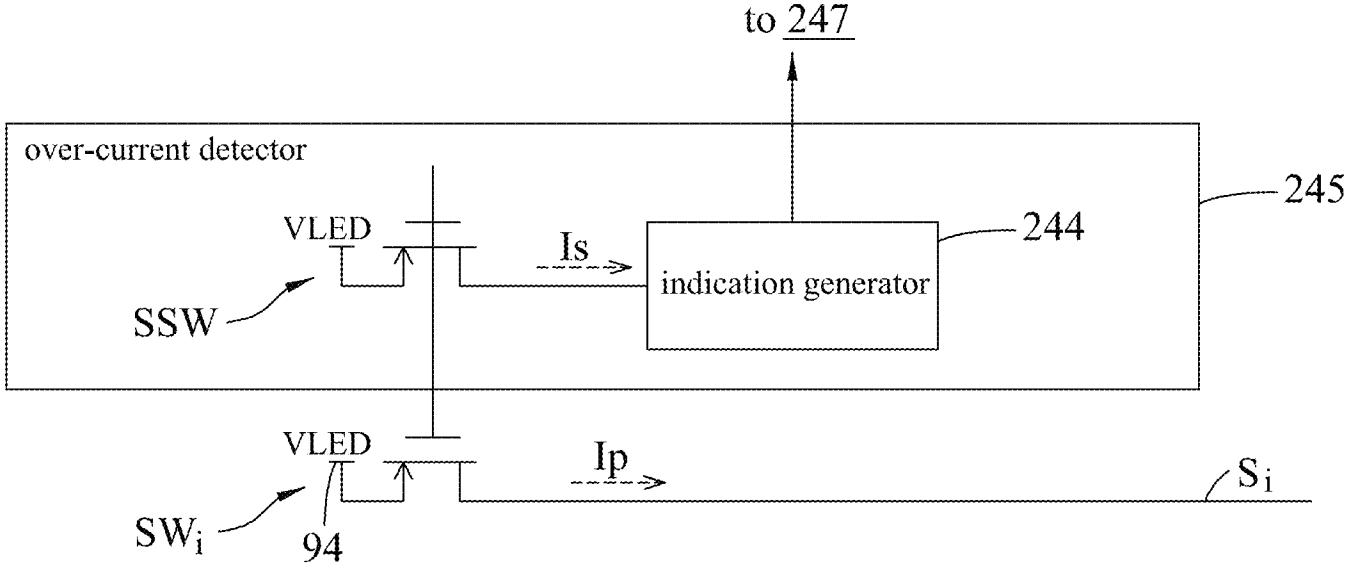
FIG. 14 is a circuit block diagram illustrating an overcurrent detector of the scan driver of the second embodiment.

Referring to FIGS. 13 and 14, each of the scan switches ($SW_1$-$SW_{32}$) and the detector switches (SSW) of the overcurrent detectors 245 is a P-type power semiconductor transistor; and the multiplexer unit 247 and the second terminals of the scan switches ($SW_1$-$SW_{32}$) are adapted to be connected to a fourth power rail 94 for receiving therefrom a third supply voltage (VLED) with a magnitude that falls within a range of 3.2V to 5V, instead of being connected to the third power rail 93 (see FIG. 8) for receiving the ground voltage therefrom.

Figure 15:
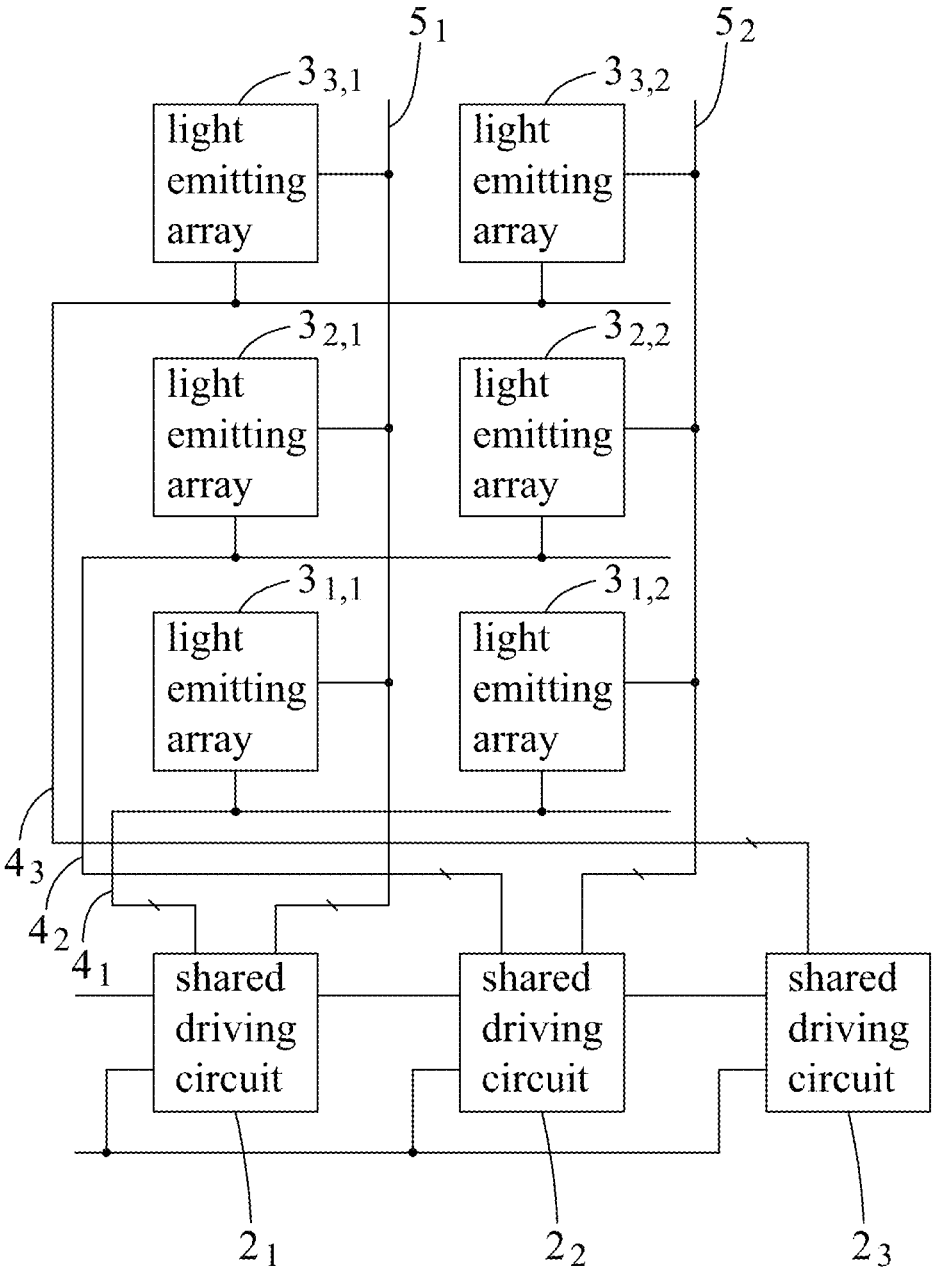
FIG. 15 a block diagram illustrating a third embodiment of the display system according to the disclosure.

Referring to FIG. 15, a third embodiment of the display system according to the disclosure is similar to the first embodiment, but differs from the first embodiment in that: (a) the channel line unit $5_3$ (see FIG. 2) and the light emitting arrays $3_{1,3}$, $3_{2,3}$, $3_{3,3}$ (see FIG. 2) are omitted (i.e., N=2 and R=6); and (b) the display system cyclically operates in the first, second, fourth, fifth, seventh and eighth modes.

Figure 16:
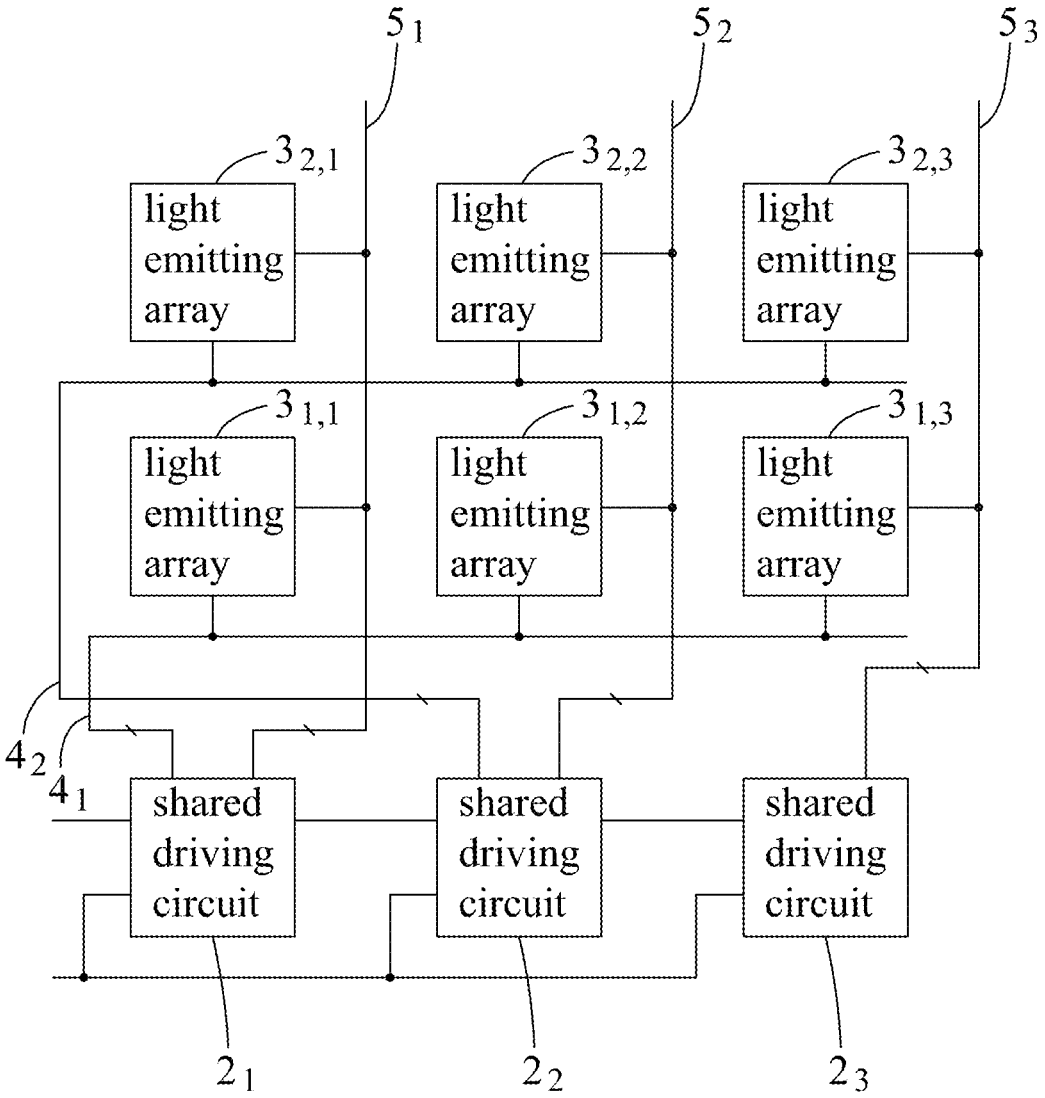
FIG. 16 a block diagram illustrating a fourth embodiment of the display system according to the disclosure.

Referring to FIG. 16, a fourth embodiment of the display system according to the disclosure is similar to the first embodiment, but differs from the first embodiment in that: (a) the scan line unit $4_3$ (see FIG. 2) and the light emitting arrays $3_{3,1}$, $3_{3,2}$, $3_{3,3}$ (see FIG. 2) are omitted (i.e., M=2 and R=6); and (b) the display system cyclically operates in the first to sixth modes.

Figure 17:
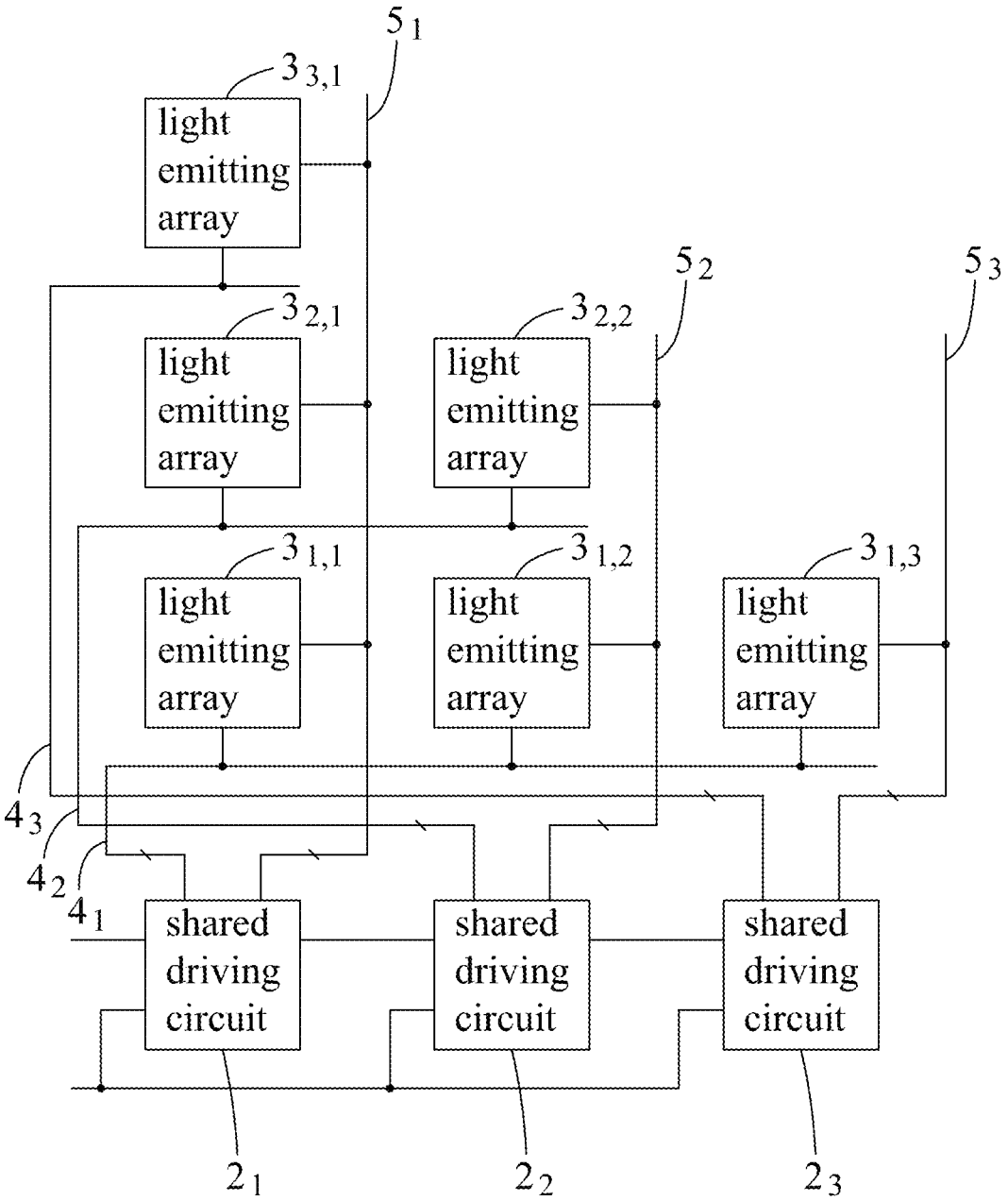
FIG. 17 a block diagram illustrating a fifth embodiment of the display system according to the disclosure.

Referring to FIG. 17, a fifth embodiment of the display system according to the disclosure is similar to the first embodiment, but differs from the first embodiment in that: (a) the light emitting arrays $3_{2,3}$, $3_{3,2}$, $3_{3,3}$ (see FIG. 2) are omitted (i.e., R=6, and the light emitting arrays $3_{1,1}$, $3_{1,2}$, $3_{1,3}$, $3_{2,1}$, $3_{2,2}$, $3_{3,1}$ are not arranged in a matrix); and (b) the display system cyclically operates in the first to fifth and seventh modes.

Referring back to FIG. 2, in view of the above, each of the aforesaid embodiments has the following advantages.

1. A number (L) of the shared driving circuits can be used to drive at most a number ($L^2$) of the light emitting arrays. As a resolution of the display system increases, the number of the shared driving circuits increases slightly, resulting in low power consumption of the display system as compared to the conventional display system.

2. Since the number of the shared driving circuits is small, the shared driving circuits can be fabricated on a single chip, thereby reducing total cost of the display system.

3. Since the number of the shared driving circuits is small, the display system has a small amount of traces to be laid out on a printed circuit board, so a printed circuit board with a few layers can be used to carry the traces of the display system, thereby reducing the total cost of the display system.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that the disclosure is not limited to the disclosed embodiments but is intended to cover various arrangements included within the spirit and scope of the broadest interpretation so as to encompass all such modifications and equivalent arrangements.

What is claimed is:

1. A display system comprising:

a number (M) of scan line units, where M>1;

a number (N) of channel line units, where N>1;

a number (R) of light emitting arrays, where R≥1; and a number (L) of shared driving circuits, where L is equal to a maximum of M and N when W≠N, and is equal to M otherwise;

each of said light emitting arrays is connected to a corresponding one of said scan line units and a corresponding one of said channel line units;

each of said shared driving circuits including a control circuit for receiving an enable control output, and generating a scan enable signal and a channel enable signal based on the enable control output, a scan driver connected to said control circuit for receiving the scan enable signal therefrom, and operable to generate or not to generate a scan driving output based on the scan enable signal, and a channel driver connected to said control circuit for receiving the channel enable signal therefrom, and operable to generate or not to generate a channel driving output based on the channel enable signal;

said scan driver of each of a number (M) of said shared driving circuits being further connected to a respective one of said scan line units for providing the scan driving output thereto;

said channel driver of each of a number (N) of said shared driving circuits being further connected to a respective one of said channel line units for providing the channel driving output thereto; and one of said light emitting arrays being connected to said scan driver of one of said shared driving circuits via the corresponding one of said scan line units, and being connected to said channel driver of another one of said shared driving circuits via the corresponding one of said channel line units.

2. The display system of claim 1, wherein each of said shared driving circuits further includes:

a clock generator for receiving a reference clock signal, and generating an internal global clock signal based on the reference clock signal; and a signal processor connected to said clock generator for receiving the internal global clock signal therefrom, for further receiving display data, providing the enable control output, and generating a scan control output and a channel control output based on the internal global clock signal and the display data;

said control circuit being further connected to said signal processor for receiving the enable control output therefrom;

said scan driver being further connected to said signal processor for receiving the scan control output therefrom, and generating the scan driving output based on the scan control output;

said channel driver being further connected to said signal processor for receiving the channel control output therefrom, and generating the channel driving output based on the channel control output.

3. The display system of claim 2, wherein said clock generator is a delay-locked loop.

4. The display system of claim 2, wherein said clock generator is a phase-locked loop.

5. The display system of claim 2, wherein for each of said shared driving circuits:

the scan driving output includes a plurality of scan driving signals;

the scan control output includes a scan clock signal and a scan control setting; and said scan driver includes a scan controller connected to said control circuit for receiving the scan enable signal therefrom, further connected to said signal processor for receiving the scan control output therefrom, and generating a plurality of scan control signals, which respectively correspond to the scan driving signals, based on the scan enable signal and the scan control output, and a plurality of scan switches each having a first terminal that is for providing a respective one of the scan driving signals, a second terminal that is adapted to be connected to a power rail, and a control terminal that is connected to said scan controller for receiving therefrom one of the scan control signals which corresponds to the respective one of the scan driving signals; and the scan driving signals are generated by said scan controller in such a way that when the scan enable signal is in an active state, at least some of said scan switches transition between conduction and non-conduction in synchrony with the scan clock signal, and a number of the at least some of said scan switches is related to the scan control setting, and when the scan enable signal is in an inactive state, none of said scan switches conducts.

6. The display system of claim 5, wherein for each of said shared driving circuits, said scan driver further includes:

a plurality of amplifiers, each of which is connected to said first terminal of a respective one of said scan switches, each of which is further connected to said scan controller for receiving therefrom one of the scan control signals that is received by the respective one of said scan switches, and each of which adjusts a magnitude of a voltage at said first terminal of the respective one of said scan switches to a predetermined reference voltage value when the one of the scan control signals causes the respective one of said scan switches to not conduct.

7. The display system of claim 5, wherein for each of said shared driving circuits, each of said scan switches is an N-type power semiconductor transistor, and is for receiving a ground voltage from the power rail.

8. The display system of claim 5, wherein for each of said shared driving circuits, each of said scan switches is a P-type power semiconductor transistor, and is for receiving, from the power rail, a supply voltage with a magnitude that falls within a range of 3.2V to 5V.

9. The display system of claim 2, wherein for each of said shared driving circuits:

the channel driving output includes a plurality of driving current signals;

the channel control output includes a current gain control setting, a reference voltage control setting, and a plurality of pulse width modulation (PWM) signals which respectively correspond to the driving current signals and each of which has a pulse width related to the display data;

said channel driver includes a control generator connected to said control circuit for receiving the channel enable signal therefrom, further connected to said signal processor for receiving the PWM signals therefrom, and generating a plurality of channel control signals, which respectively correspond to the driving current signals, based on the channel enable signal and the PWM signals, a current gain controller connected to said signal processor for receiving the current gain control setting therefrom, and generating a current gain control output based on the current gain control setting, a current provider connected to said current gain controller for receiving the current gain control output therefrom, providing a plurality of driving currents, and adjusts magnitudes of the driving currents based on the current gain control output, a plurality of channel switches each having a first terminal that is connected to said current provider, a second terminal that is for providing a respective one of the driving current signals, and a control terminal that is connected to said control generator for receiving therefrom one of the channel control signals which corresponds to the respective one of the driving current signals, each of said channel switches permitting a respective one of the driving currents to flow therethrough when conducting, and an amplifier unit connected to said second terminals of said channel switches, further connected to said signal processor for receiving the reference voltage control setting therefrom, and further connected to said control generator for receiving the channel control signals therefrom, for each of said channel switches, said amplifier unit adjusting a magnitude of a voltage at said second terminal of said channel switch to a reference voltage value based on the reference voltage control setting when one of the channel control signals that is received by said channel switch causes said channel switch to not conduct, for each of the driving current signals, said control generator outputting one of the PWM signals that corresponds to the driving current signal to serve as one of the channel control signals that corresponds to the driving current signal when the channel enable signal is in an active state, and outputting a predetermined reference voltage with a magnitude corresponding to non-conduction of said channel switches to serve as the one of the channel control signals when the channel enable signal is in an inactive state.

10. The display system of claim 9, wherein for each of said shared driving circuits:

said current provider is adapted to be further connected to a first power rail for receiving therefrom a first supply voltage with a magnitude that falls within a range of 2.4V to 4.5V, and a second power rail for receiving therefrom a second supply voltage with a magnitude that falls within a range of 3.2V to 4.5V; and some of the driving currents are sourced from the first power rail, and remaining ones of the driving currents are sourced from the second power rail.

11. The display system of claim 2, wherein for each of said shared driving circuits:

said signal processor includes a controller connected to said clock generator for receiving the internal global clock signal therefrom, for further receiving a data clock signal, generating a channel clock signal, a scan clock signal and an enable clock signal in synchrony with the internal global clock signal, and generating a configuration clock signal in synchrony with the data clock signal, an input/output (I/O) interface for receiving the data clock signal, and for further receiving the display data and a plurality of control settings in synchrony with the data clock signal, a configuration register connected to said controller for receiving the configuration clock signal therefrom, and further connected to said I/O interface for receiving and storing the control settings therefrom in synchrony with the configuration clock signal, and a pulse width modulator connected to said controller for receiving the channel clock signal therefrom, further connected to said I/O interface for receiving the display data therefrom, and performing pulse width modulation (PWM) based on the display data in synchrony with the channel clock signal to generate a plurality of PWM signals;

the enable control output includes the enable clock signal generated by said controller, and one of the control settings stored in said configuration register;

the scan control output includes the scan clock signal generated by said controller, and another one of the control settings stored in said configuration register; and the channel control output includes the PWM signals generated by said pulse width modulator, and yet another one of the control settings stored in said configuration register.

12. The display system of claim 1, wherein:

each of said light emitting arrays includes a plurality of light emitting elements; and each of said light emitting elements of said light emitting arrays includes a red light emitting diode (LED), a green LED and a blue LED.

13. A shared driving circuit to be used in a display system, the display system including at least one scan line unit, at least one channel line unit, and at least one light emitting array that is connected to the at least one scan line unit and the at least one channel line unit, said shared driving circuit comprising:

a clock generator for receiving a reference clock signal, and generating an internal global clock signal based on the reference clock signal;

a signal processor connected to said clock generator for receiving the internal global clock signal therefrom, for further receiving display data, providing an enable control output, and generating a scan control output and a channel control output based on the internal global clock signal and the display data;

a control circuit connected to said signal processor for receiving the enable control output therefrom, and generating a scan enable signal and a channel enable signal based on the enable control output;

a scan driver connected to said signal processor and said control circuit for receiving the scan control output and the scan enable signal respectively therefrom, and operable to generate or not to generate a scan driving output based on the scan enable signal, the scan driving output being generated based on the scan control output; and a channel driver connected to said signal processor and said control circuit for receiving the channel control output and the channel enable signal respectively therefrom, and operable to generate or not to generate a channel driving output based on the channel enable signal, the channel driving output being generated based on the channel control output;

said scan driver being further connected to one of the at least one scan line unit for providing the scan driving output thereto;

said channel driver being further connected to one of the at least one channel line unit for providing the channel driving output thereto.

14. The shared driving circuit of claim 13, wherein said clock generator is one of a phase-locked loop and a delay-locked loop.

15. The shared driving circuit of claim 13, wherein:

the channel driving output includes a plurality of driving current signals;

the channel control output includes a current gain control setting, a reference voltage control setting, and a plurality of pulse width modulation (PWM) signals which respectively correspond to the driving current signals and each of which has a pulse width related to the display data;

said channel driver includes a control generator connected to said control circuit for receiving the channel enable signal therefrom, further connected to said signal processor for receiving the PWM signals therefrom, and generating a plurality of channel control signals, which respectively correspond to the driving current signals, based on the channel enable signal and the PWM signals, a current gain controller connected to said signal processor for receiving the current gain control setting therefrom, and generating a current gain control output based on the current gain control setting, a current provider connected to said current gain controller for receiving the current gain control output therefrom, providing a plurality of driving currents, and adjusts magnitudes of the driving currents based on the current gain control output, a plurality of channel switches each having a first terminal that is connected to said current provider, a second terminal that is for providing a respective one of the driving current signals, and a control terminal that is connected to said control generator for receiving therefrom one of the channel control signals which corresponds to the respective one of the driving current signals, each of said channel switches permitting a respective one of the driving currents to flow therethrough when conducting, and an amplifier unit connected to said second terminals of said channel switches, further connected to said signal processor for receiving the reference voltage control setting therefrom, and further connected to said control generator for receiving the channel control signals therefrom, for each of said channel switches, said amplifier unit adjusting a magnitude of a voltage at said second terminal of said channel switch to a reference voltage value based on the reference voltage control setting when one of the channel control signals that is received by said channel switch causes said channel switch to not conduct, for each of the driving current signals, said control generator outputting one of the PWM signals that corresponds to the driving current signal to serve as one of the channel control signals that corresponds to the driving current signal when the channel enable signal is in an active state, and outputting a predetermined reference voltage with a magnitude corresponding to non-conduction of said channel switches to serve as the one of the channel control signals when the channel enable signal is in an inactive state.

16. The shared driving circuit of claim 15, wherein:

said current provider is adapted to be further connected to a first power rail for receiving therefrom a first supply voltage with a magnitude that falls within a range of 2.4V to 4.5V, and a second power rail for receiving therefrom a second supply voltage with a magnitude that falls within a range of 3.2V to 4.5V; and some of the driving currents are sourced from the first power rail, and remaining ones of the driving currents are sourced from the second power rail.

17. The shared driving circuit of claim 13, wherein:

the scan driving output includes a plurality of scan driving signals;

the scan control output includes a scan clock signal and a scan control setting; and said scan driver includes a scan controller connected to said control circuit for receiving the scan enable signal therefrom, further connected to said signal processor for receiving the scan control output therefrom, and generating a plurality of scan control signals, which respectively correspond to the scan driving signals, based on the scan enable signal and the scan control output, and a plurality of scan switches each having a first terminal that is for providing a respective one of the scan driving signals, a second terminal that is adapted to be connected to a power rail, and a control terminal that is connected to said scan controller for receiving therefrom one of the scan control signals which corresponds to the respective one of the scan driving signals; and the scan driving signals are generated by said scan controller in such a way that when the scan enable signal is in an active state, at least some of said scan switches transition between conduction and non-conduction in synchrony with the scan clock signal, and a number of the at least some of said scan switches is related to the scan control setting, and when the scan enable signal is in an inactive state, none of said scan switches conducts.

18. The shared driving circuit of claim 17, wherein each of said scan switches is an N-type power semiconductor transistor, and is for receiving a ground voltage from the power rail.

19. The shared driving circuit of claim 17, wherein each of said scan switches is a P-type power semiconductor transistor, and is for receiving, from the power rail, a supply voltage with a magnitude that falls within a range of 3.2V to 5V.

* * * * *